US008054007B2

(12) United States Patent
Yang

(10) Patent No.: US 8,054,007 B2
(45) **Date of Patent: *Nov. 8, 2011**

(54) BI-DIRECTIONAL LIGHT EMITTING DIODE DRIVE CIRCUIT IN BI-DIRECTIONAL POWER SERIES RESONANCE

(76) Inventor: Tai-Her Yang, Dzan-Hwa (TW)

( * ) Notice: Subject to any disclaimer, the term of this patent is extended or adjusted under 35 U.S.C. 154(b) by 354 days.

This patent is subject to a terminal disclaimer.

(21) Appl. No.: 12/351,917

(22) Filed: Jan. 12, 2009

(65) Prior Publication Data

US 2009/0179593 A1 Jul. 16, 2009

Related U.S. Application Data

(60) Provisional application No. 61/020,823, filed on Jan. 14, 2008.

(51) Int. Cl.
*H05B 41/36* (2006.01)

(52) U.S. Cl. ..... 315/307; 315/291; 315/250; 315/224

(58) Field of Classification Search ..... 315/227 R, 315/228, 239, 244, 291, 276, 283, 246, 248, 315/258, 290, 297, 307
See application file for complete search history.

(56) References Cited

U.S. PATENT DOCUMENTS

| | | | | |
|---|---|---|---|---|
| 2003/0122502 | A1* | 7/2003 | Clauberg et al. | 315/291 |
| 2008/0054814 | A1* | 3/2008 | Deppe et al. | 315/192 |
| 2010/0060182 | A1* | 3/2010 | Stack | 315/228 |
| 2011/0018458 | A1* | 1/2011 | Wei | 315/276 |

* cited by examiner

*Primary Examiner* — Shawki S Ismail
*Assistant Examiner* — Jany Tran
(74) *Attorney, Agent, or Firm* — Rabin & Berdo, P.C.

(57) ABSTRACT

The present invention uses the capacitive impedance component to constituted the first impedance and the inductive impedance component to constituted the second impedance, which is characterized as that the first and second impedances in series connection is configured to appear series resonance with the inputting bi-directional power to form a bi-directional divided power, thereby using the bi-directional divided power to drive the bi-directional conducting light emitting diode in parallel connection with the first impedance and second impedance.

23 Claims, 9 Drawing Sheets

BI-DIRECTIONAL LIGHT EMITTING DIODE DRIVE CIRCUIT IN BI-DIRECTIONAL POWER SERIES RESONANCE

BACKGROUND OF THE INVENTION (a) Field of the Present Invention

The bi-directional light emitting diode drive circuit in bi-directional power series resonance is disclosed by that a first impedance is constituted by a capacitive component, and a second impedance is constituted by an inductive component, whereof they are in mutual series connection, and their inherent series resonance frequency is the same as the frequency or period of the bi-directional power source to generate a series resonance status. Thereof it is characterized in that when in series resonance, a bi-directional divided power is formed across the two ends of the capacitive impedance component and the inductive impedance component in mutual series connection, whereby the divided power is used to drive a bi-directional conducting light emitting diode which is either parallel connected with the first impedance or the second impedance, or at least two bi-directional light emitting diodes which are respectively parallel connected across the two ends of the first impedance and the second impedance are driven by the divided power across the two ends of the first impedance and the two ends of the second impedance.

(b) Description of the Prior Art

The conventional light emitting diode drive circuit using AC or DC power source is usually series connected with current limit resistors as the impedance to limit the current to the light emitting diode, whereof the voltage drop of the series connected resistive impedance always result in waste of power and accumulation of heat which are the imperfections.

SUMMARY OF THE INVENTION

The present invention is disclosed by that a first impedance is constituted by a capacitive impedance component and a second impedance is constituted by an inductive impedance component, whereof the inherent series resonance frequency of the first impedance and the second impedance in series connection is the same as the frequency of the bi-directional AC power source, or the alternated polarity period of the constant or variable voltage converted from a DC power and the constant or variable periodically alternated polarity power, thereby to produce a series resonance status; whereof in series resonance, a bi-directional divided power in series resonance is formed across the two ends of the capacitive impedance component or the inductive impedance component for driving the bi-directional conducting light emitting diode which is parallel connected across the two ends of the first impedance or the second impedance to emit light.

DESCRIPTION OF MAIN COMPONENT SYMBOLS

Figure 1:
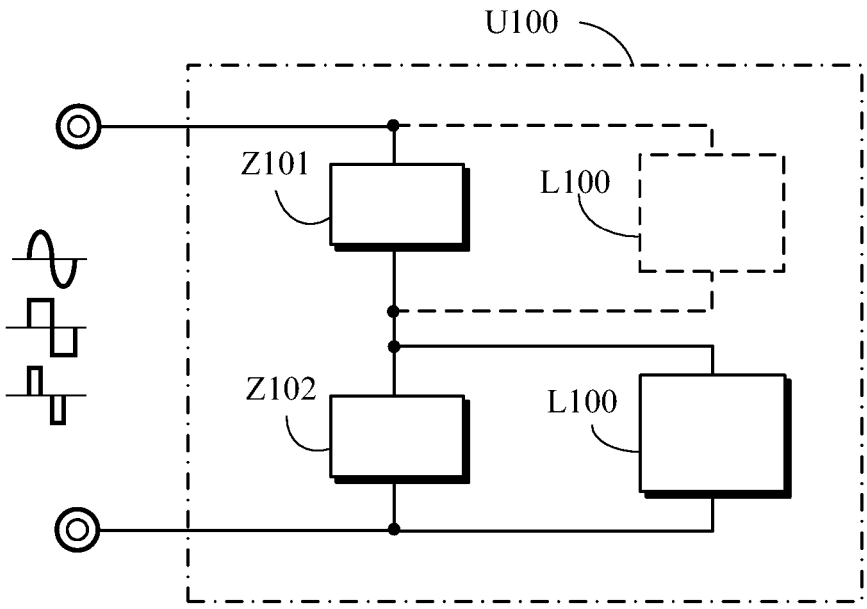
FIG. 1 is the schematic block diagram of the bi-directional light emitting diode drive circuit in bi-directional power series resonance.

C100: Capacitor
CR100, CR101, CR102, CR201, CR202: Diode
ESD101, ESD102: Charge/discharge device
I100, I103, I104, I200: Inductive impedance component
IT200: Separating type transformer
L100: Bi-directional conducting light emitting diode set
LED101: First light emitting diode
LED102: Second light emitting diode
R101: Discharge resistor
R100, R103, R104: Current limit resistor
ST200: Self-coupled transformer
U100: Bi-directional light emitting diode (LED) drive circuit
W0: Self-coupled voltage change winding
W1: Primary side winding
W2: Secondary side winding
Z101: First impedance
Z102: Second impedance
ZD101, ZD102: Zener diode
300: Bi-directional power modulator of series connection type
400: Bi-directional power modulator of parallel connection type
500: Impedance component
600: Switching device
4000: DC to AC Inverter

DETAILED DESCRIPTION OF THE PREFERRED EMBODIMENTS

The bi-directional light emitting diode drive circuit (U100) of the bi-directional light emitting diode drive circuit in bi-directional power series resonance, in which at least one first impedance is constituted by capacitive impedance components and at least one second impedance is constituted by inductive impedance components, whereof at least one first light emitting diode is reversely parallel connected with a second light emitting diode to constitute at least one bi-directional conducting light emitting diode set which is parallel connected across the two ends of at least one first impedance or at least one second impedance, while the first impedance and the second impedance in series connection is provided for inputting:

(1) The AC power with a constant or variable voltage and a constant or variable frequency; or
(2) The AC power of bi-directional sinusoidal wave voltage or bi-directional square wave voltage, or bi-directional pulse wave voltage with constant or variable voltage and constant or variable frequency or period which is converted from a DC power source; or
(3) The AC power of bi-directional sinusoidal wave voltage or bi-directional square wave voltage, or bi-directional pulse wave voltage with constant or variable voltage and constant or variable frequency or period converted from the DC power which is further rectified from an AC power;

The bi-directional divided power in series resonance formed at the first impedance or the second impedance in series resonance is used to drive at least one bi-directional conducting light emitting diode set which is parallel connected across the two ends of either the first impedance or the second impedance, or at least two bi-directional conducting light emitting diodes which are respectively parallel connected across the two ends of the first impedance and the second impedance to be respectively driven by the divided power across the two ends of the first impedance and the two ends of the second impedance, thereby to constitute the bi-directional light emitting diode drive circuit in bi-directional power series resonance of the present invention.

FIG. 1 is the schematic block diagram of the bi-directional light emitting diode drive circuit in bi-directional power series resonance, in which the circuit function is operated through the bi-directional light emitting diode drive circuit (U100) as shown in FIG. 1, whereof it is mainly comprised of that:

A first impedance (Z101) is comprised of:

A first impedance (Z101) which is mainly constituted by at least one capacitive impedance component, or two or more than two capacitive impedance components in series connection or parallel connection or series and parallel connection, or A first impedance (Z101) is comprised of a capacitive impedance component, and it can be optionally installed as needed with one kind or more than one kind and one or more than one additional inductive impedance components or capacitive impedance components, or optionally installed as needed with two or more than two kinds of impedance components, whereof each kind of impedance components is constituted in series connection or parallel connection or series and parallel connection.

A second impedance (Z102) is mainly constituted by at least one inductive impedance component or two or more than two inductive impedance components in series connection, or parallel connection, or series and parallel connection, or A second impedance (Z102) is comprised of at least one inductive impedance component, and it can be optionally installed as needed with one kind or more than one kind and one or more than one additional capacitive impedance components or resistive impedance components, or optionally installed as needed with two kinds or more than two kinds of impedance components, whereof each kind of impedance components is constituted in series connection or parallel connection or series and parallel connection;

The inherent series resonance frequency of the at least one first impedance component (Z101) and at least one second impedance (Z102) in series connection is the same as the frequency of the AC power from power source, or the period of the periodically alternated polarity DC power, thereby to produce a series resonance status, whereof in series resonance, the bi-directional power input is formed by the first impedance (Z101) and the second impedance (Z102) into the bi-directional divided power in series resonance, whereby the bi-directional conducting light emitting diode set (L100) which is parallel connected with the first impedance (Z101) or the second impedance (Z102) is driven by the said divided power to emit light;

A bi-directional conducting light emitting diode set (L100): It is constituted by at least one first light emitting diode (LED101) and at least one second light emitting diode (LED102) in parallel connection of inverse polarities, whereof the number of first light emitting diodes (LED101) and the number of second light emitting diodes (LED102) can be the same or different, and the first light emitting diode (LED101) and the second light emitting diode (LED102) are individually constituted by a forward current polarity light emitting diode, or by two or more than two forward current polarity light emitting diodes in series connection or parallel connection, or by three or more than three forward current polarity light emitting diodes in series connection, parallel connection or series and parallel connection;

One or more than one set of the bi-directional conducting light emitting diode set (L100) can be optionally selected as needed to be parallel connected across the two ends of either the first impedance (Z101) or the second impedance (Z102), whereof the bi-directional divided power in series resonance is formed across the two ends of the first impedance (Z101) and the two ends of the second impedance (Z102) from power input, whereby the bi-directional conducting light emitting diode set (L100) which is parallel connected across the two ends of the first impedance (Z101) or the second impedance (Z102) is driven by the said divided power to emit light.

The bi-directional divided power in series resonance formed at the first impedance or the second impedance in series resonance by means of above said powers to drive at least one bi-directional conducting light emitting diode set which is parallel connected across the two ends of either the first impedance or the second impedance, or to drive at least two bi-directional conducting light emitting diode sets which are respectively parallel connected across the two ends of the first impedance and the second impedance, thereby to constitute the bi-directional light emitting diode drive circuit in bi-directional power series resonance of the present invention.

The bi-directional light emitting diode drive circuit (U100) in the bi-directional light emitting diode drive circuit in bi-directional power series resonance of the present invention, in which the first impedance (Z101) and the second impedance (Z102) as well as the bi-directional conducting light emitting diode set (L100) can be optionally selected to be one or more than one as needed.

Figure 2:
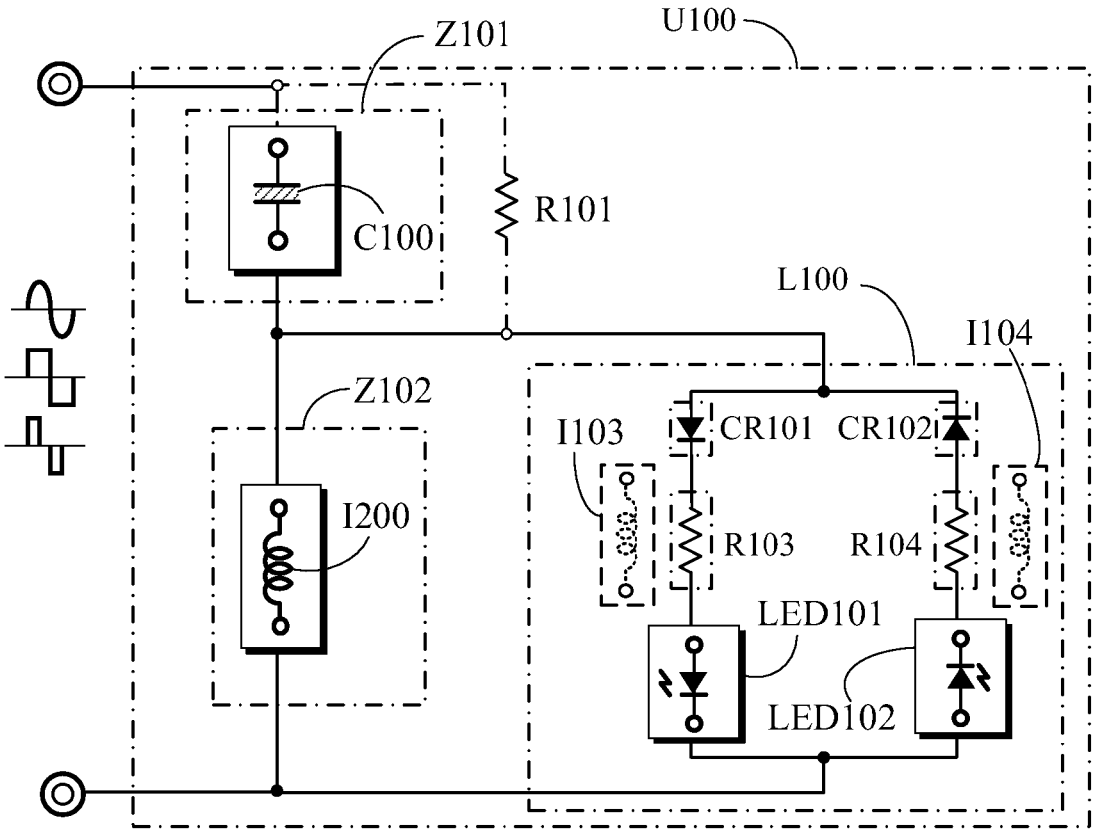
FIG. 2 is the circuit example schematic diagram of the present invention.

For convenience of description, the components listed in the circuit examples of the following exemplary embodiments are selected as in the following:

(1) A first impedance (Z101) and a second impedance (Z102) as well as a bi-directional conducting light emitting diode set (L100) are installed in the embodied examples. Nonetheless, the selected quantities are not limited in actual applications;

(2) The capacitive impedance of the capacitor is selected to represent the impedance components, thereby to constitute the first impedance (Z101) and second impedance (Z102) in the embodied examples, whereof the capacitive, inductive and/or resistive impedance components can be optionally selected as needed in actual applications, whereby it is described in the following:

FIG. 2 is the circuit example schematic diagram of the present invention which is mainly constituted by the following:

A first impedance (Z101): it is constituted by at least one capacitive impedance component, especially by the capacitor (C100), whereof the number of the first impedance (Z101) can be one or more than ones;

A second impedance (Z102): it is constituted by at least one inductive impedance component (I200), whereof the number of the second impedance (Z102) can be one or more than ones;

At least one first impedance (Z101) and at least one second impedance (Z102) are in series connection, whereof the two ends of them after series connection are provided for inputting (1) The AC power with a constant or variable voltage and a constant or variable frequency; or (2) The AC power of bi-directional sinusoidal wave voltage or bi-directional square wave voltage, or bi-directional pulse wave voltage with constant or variable voltage and constant or variable frequency or period which is converted from a DC power source; or (3) The AC power of bi-directional sinusoidal wave voltage or bi-directional square wave voltage, or bi-directional pulse wave voltage with constant or variable voltage and constant or variable frequency or period converted from the DC power which is further rectified from an AC power;

By means of above said power input, the bi-directional divided power in series resonance is formed at the first impedance and the second impedance in series connection, whereby at least one bi-directional conducting light emitting diode set (L100) is driven by the said divided power.

Figure 3:
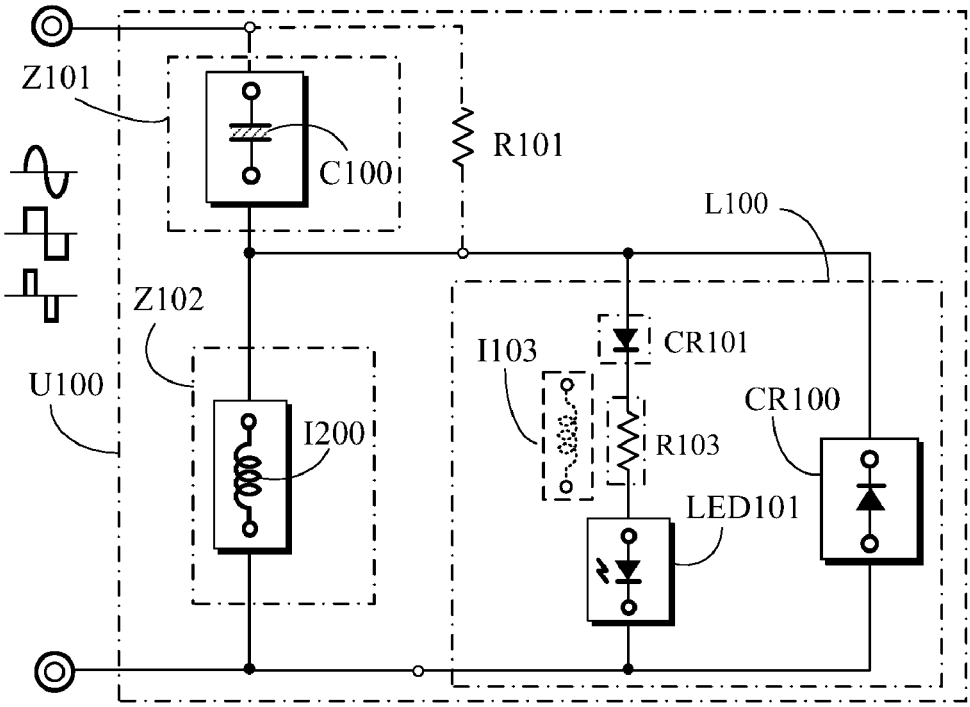
FIG. 3 is a circuit example schematic diagram of the present invention illustrating that the bi-directional conducting light emitting diode set is constituted by a first light emitting diode and a diode in parallel connection of opposite polarities.
Figure 4:
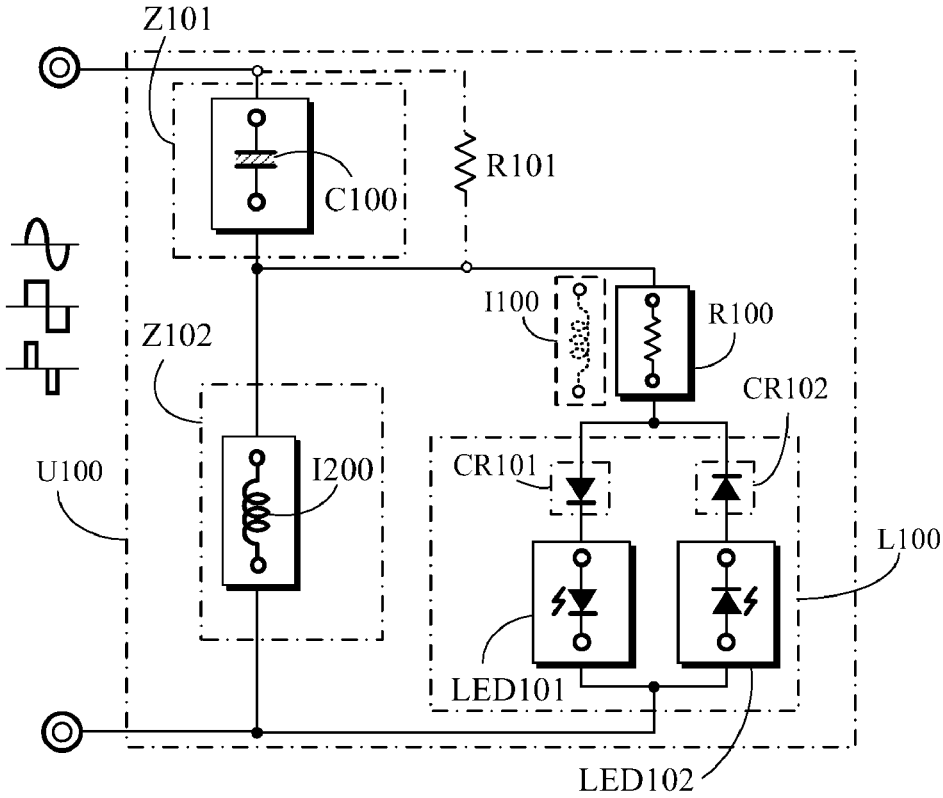
FIG. 4 is a circuit example schematic diagram illustrating that the bi-directional conducting light emitting diode set is series connected with a current limit resistor.
Figure 5:
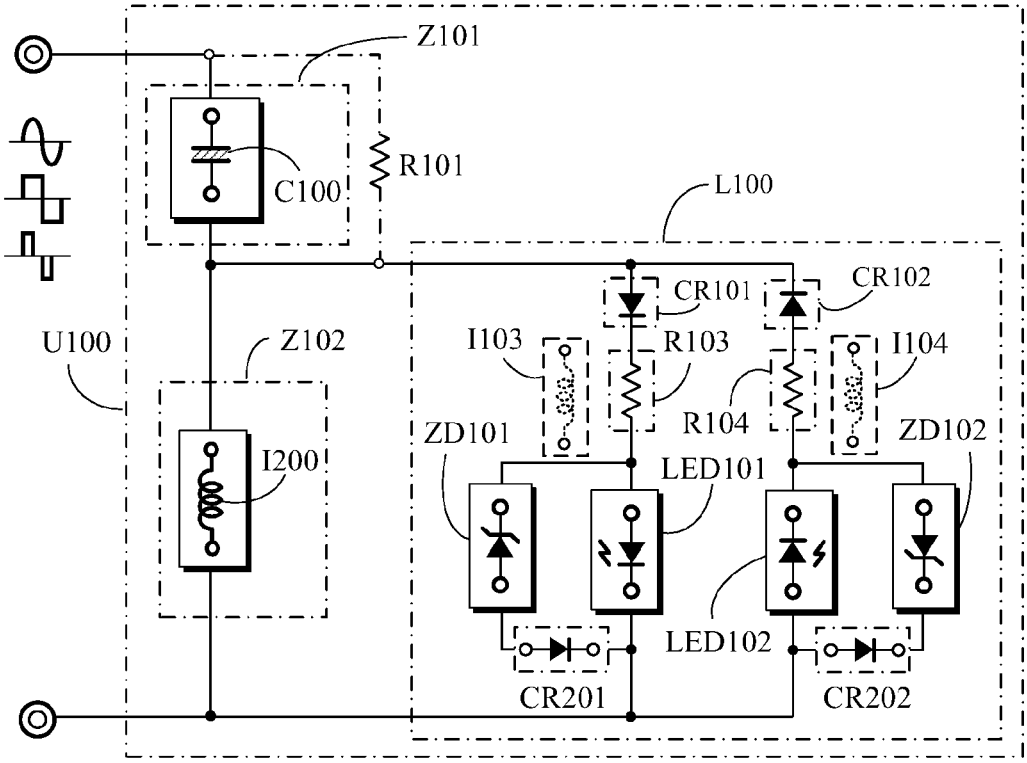
FIG. 5 is a circuit example schematic diagram illustrating that the bi-directional conducting light emitting diode set in the circuit of FIG. 2 is further installed with a zener diode.
Figure 6:
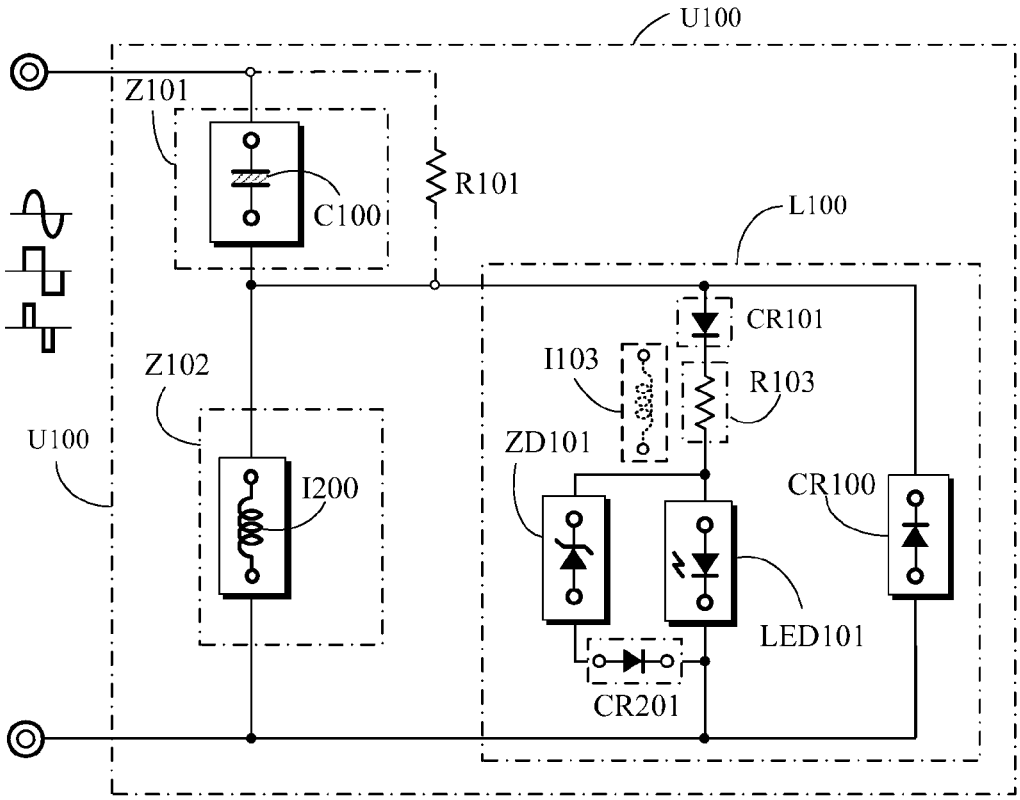
FIG. 6 is a circuit example schematic diagram illustrating that the bi-directional conducting light emitting diode set in the circuit of FIG. 3 is further installed with a zener diode.
Figure 7:
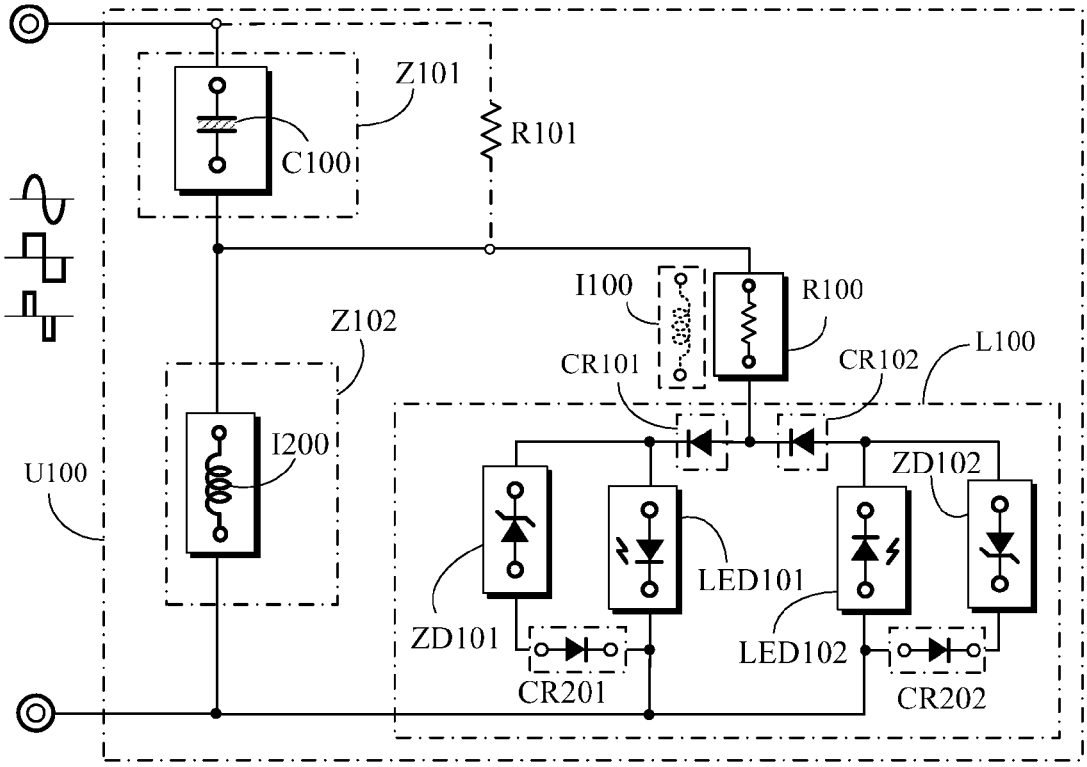
FIG. 7 is a circuit example schematic diagram illustrating that the bi-directional conducting light emitting diode set in the circuit of FIG. 4 is further installed with a zener diode.

The series resonance frequency of the first impedance (Z101) and the second impedance (Z102) in series connection is the same as the frequency of AC power from power source or the period of periodically alternated polarity DC power, thereby to produce a series resonance status;

A bi-directional conducting light emitting diode set (L100): it is constituted by at least one first light emitting diode (LED101) and at least one second light emitting diode (LED102) in parallel connection of inverse polarities, whereof the number of the first light emitting diode (LED101) and the number of the second light emitting diode (LED102) can be the same or different, further, the first light emitting diode (LED101) and the second light emitting diode (LED102) can be individually constituted by a forward current light emitting diode; or two or more than two forward current polarity light emitting diodes in series or parallel connections; or three or more than three forward current polarity light emitting diodes in series or parallel connections or in series and parallel connections. The bi-directional conducting light emitting diode set (L100) can be optionally installed with one or more than one sets as needed, whereof it is parallel connected across the two ends of both or either of the first impedance (Z101) or the second impedance (Z102) to form the divided power for driving the bi-directional light emitting diode set (L100) which is parallel connected across the two ends of the first impedance (Z101) or the second impedance (Z102) to emit light; or At least one bi-directional conducting light emitting diode set (L100) is parallel connected to the two ends of at least one second impedance (Z102), i.e. it is parallel connected across the two ends of the inductive impedance component (I200) which constitutes the second impedance (Z102), thereby it is driven by the divided power across the two ends of the inductive impedance component (I200) while the impedance of the first impedance (Z101) is used to limit its current, whereof in case that the capacitor (C100) (such as a bipolar capacitor) is used as the first impedance component, the output current is limited by the capacitive impedance;

The first impedance (Z101), the second impedance (Z102) and the bi-directional conducting light emitting diode set (L100) are connected according to the aforesaid circuit structure to constitute the bi-directional light emitting diode drive circuit (U100);

Besides, through the current distribution effect formed by the parallel connection of the bi-directional conducting light emitting diode set (L100) and the second impedance (Z102), the voltage variation rate across the two ends of the bi-directional conducting light emitting diode set (L100) corresponding to power source voltage variation can be reduced;

Selection of the first light emitting diode (LED101) and the second light emitting diode (LED102) which constitute the bi-directional conducting light emitting diode set (L100) in the bi-directional light emitting diode drive circuit (U100) includes the following:

1. The first light emitting diode (LED101) which can be constituted by one light emitting diode, or by more than one light emitting diodes in series connection of forward polarities, or in parallel connection of the same polarity or in series and parallel connection;

2. The second light emitting diode (LED102) which can be constituted by one light emitting diode, or by more than one light emitting diodes in series connection of forward polarities, or in parallel connection of the same polarity or in series and parallel connection;

3. The number of light emitting diodes which constitute the first light emitting diode (LED101) and the number of light emitting diodes which constitute the second light emitting diode (LED102) can be the same or different;

4. If the number of light emitting diodes which constitute the first light emitting diode (LED101) and the second light emitting diode (LED102) respectively is more than one, the connecting relationship of the respective light emitting diodes can be in the same or different series connection, parallel connection or series and parallel connection;

5. Either the first light emitting diode (LED101) or the second light emitting diode (LED102) can be replaced by a diode (CR100), whereof the current direction of the said (CR100) and the current direction of either the first light emitting diode (LED101) or the second light emitting diode (LED102) which is reserved for parallel connection are parallel connected of inverse polarity;

FIG. 3 is a circuit example schematic diagram of the present invention illustrating that the bi-directional conducting light emitting diode set is constituted by a first light emitting diode and a diode in parallel connection of inverse polarity;

The bi-directional light emitting diode drive circuit in bi-directional power series resonance is operated through the circuit function of the bi-directional light emitting diode drive circuit (U100), whereof in actual applications, as shown in FIGS. 1, 2 and 3, the following auxiliary circuit components can be optionally selected as needed to be installed or not installed while the quantity of the installation can be constituted by one or more than one, whereof in case more than one are selected, they can be selected based on circuit function requirements to be in series connection or in parallel connection or in series and parallel connection in corresponding polarities, whereof the optionally selected auxiliary circuit components include:

(1) A diode (CR101): It is optionally installed as needed to be series connected with the first light emitting diode (LED101) to avoid reverse over-voltage, whereof it can be constituted by one or more than one in series connection, parallel connection or series and parallel connections;

(2) A diode (CR102): It is optionally installed as needed to be series connected with the second light emitting diode (LED102) to avoid reverse over-voltage, whereof it can be constituted by one or more than one in series connection, parallel connection or series and parallel connections;

(3) A discharge resistor (R101): It is an optionally installed component as needed to be parallel connected across the two ends of the capacitor (C100) of the first impedance (Z101) for discharging the residual charge of the capacitor (C100), whereof it can be constituted by one or more than one in series connection, parallel connection or series and parallel connections;

(4) A current limit resistor (R103): It is an optionally installed component as needed to be individually series connected with each of the first light emitting diodes (LED101) of the bi-directional conducting light emitting diode set (L100), whereby it is used to limit the current passing through the first light emitting diode (LED101); whereof the current limit resistor (R103) can also be replaced by an inductive impedance component (I103), further, it can be constituted by one or more than one in series connection, parallel connection or series and parallel connections;

(5) A current limit resistor (R104): It is an optionally installed component as needed to be individually series connected with each of the second light emitting diodes (LED102) of the bi-directional conducting light emitting diode set (L100), whereby it is used to limit the current passing through the second light emitting diode (LED102); whereof the current limit resistor (R104) can also be replaced by an inductive impedance component (I104), further, it can be constituted by one or more than one in series connection, parallel connection or series and parallel connections;

(6) If the first light emitting diode (LED101) and the second light emitting diode (LED102) of the bi-directional conducting light emitting diode set (L100) in the bi-directional light emitting diode drive circuit (U100) in series resonance are installed with current limit resistors (R103) and (R104) simultaneously, they can be directly replaced by or installed together with series connecting a current limit resistor (R100) with the bi-directional conducting light emitting diode set (L100). Further, the current limit resistor (R100) can also be replaced by the inductive impedance (I100);

The above said circuit structure and auxiliary circuit components are selected to constitute the bi-directional light emitting diode drive circuit (U100), whereof, FIG. 4 is a circuit example schematic diagram illustrating that the bi-directional conducting light emitting diode set is series connected with a current limit resistor;

In addition, to protect the light emitting diode and to avoid the light emitting diode being damaged or reduced working life by abnormal voltage, a zener diode can be further parallel connected across the two ends of the first light emitting diode (LED101) or the second light emitting diode (LED102) in the bi-directional conducting light emitting diode set (L100), or the zener diode is first series connected with at least one diode to produce a zener voltage function, then parallel connected across the two ends of the first light emitting diode (LED101) or the second light emitting diode (LED102);

FIG. 5 is a circuit example schematic diagram illustrating that the bi-directional conducting light emitting diode set in the circuit of FIG. 2 is further installed with a zener diode;

FIG. 6 is a circuit example schematic diagram illustrating that the bi-directional conducting light emitting diode set in the circuit of FIG. 3 is further installed with a zener diode;

FIG. 7 is a circuit example schematic diagram illustrating that the bi-directional conducting light emitting diode set in the circuit of FIG. 4 is further installed with a zener diode;

As shown in FIGS. 5, 6 and 7, whereof it is constituted by the following:

1. A zener diode (ZD101) is parallel connected across the two ends of the first light emitting diode (LED101) of the bi-directional conducting light emitting diode set (L100), whereof its polarity relationship is that the zener voltage of the zener diode (ZD101) is used to limit the working voltage across the two ends of the first light emitting diode (LED101);

The said zener diode (ZD101) can be optionally series connected with a diode (CR201) as needed, the advantages are 1) the zener diode (ZD101) can be protected from reverse current; 2) both diode (CR201) and zener diode (ZD101) have temperature compensation effects.

2. If the second light emitting diode (LED102) is selected to constitute the bi-directional conducting light emitting diode set (L100), a zener diode (ZD102) can be selected to parallel connect across the two ends of the second light emitting diode (LED102), whereof their polarity relationship is that the zener voltage of the zener diode (ZD102) is used to limit the working voltage across the two ends of the second light emitting diode (LED102);

The said zener diode (ZD102) can be optionally series connected with a diode (CR202) as needed, the advantages are 1) the zener diode (ZD102) can be protected from reverse current; 2) both diode (CR202) and zener diode (ZD102) have temperature compensation effects.

If the bi-directional conducting light emitting diode set (L100) in the bi-directional light emitting diode drive circuit (U100) of the bi-directional light emitting diode drive circuit in bi-directional power series resonance is selected to be constituted by the first light emitting diode (LED101) and the second light emitting diode (LED102) in parallel connection of opposite polarities, its constitutions include the following:

A zener diode (ZD101) can be optionally parallel connected as needed across the two ends of the first light emitting diode (LED101) or a zener diode can be optionally parallel connected as needed across the two ends of the second light emitting diode (LED102), whereof their polarity relationships are that the zener voltage of the zener diode (ZD101) is used to limit the voltage across the two ends of the first light emitting diode (LED101), and the zener voltage of the zener diode (ZD102) is used to limit the voltage across the two ends of the second light emitting diode (LED102);

The above said zener diode is constituted by the following:

(1) A zener diode (ZD101) is parallel connected across the two ends of the first light emitting diode (LED101) of the bi-directional conducting light emitting diode set (L100), and a zener diode (ZD102) is parallel connected across the two ends of the second light emitting diode (LED102); or (2) The two zener diodes (ZD101) and (ZD102) are series connected in opposite directions and are further parallel connected across the two ends of the bi-directional conducting light emitting diode set (L100); or (3) Or it can be replaced by parallel connecting a diode with bi-directional zener effect in the circuit of bi-directional conducting light emitting diode set (L100);

All the above said three circuits can avoid over high end voltage of the first light emitting diode (LED101) and the second light emitting diode (LED102); or If the bi-directional conducting light emitting diode set (L100) of the bi-directional light emitting diode drive circuit (U100) in the bi-directional light emitting diode drive circuit in bi-directional power series resonance of the present invention is selected to be constituted by the first light emitting diode (LED101) and the second light emitting diode (LED102) in parallel connection of opposite directions, the constitutions include the following:

The said zener diodes (ZD101) and (ZD102) can be optionally constituted as needed by that a diode (CR201) and a zener diode (ZD101) are in series connection of forward polarities, and a diode (CR202) and a zener diode (ZD102) are in series connection of forward polarities, whereof their advantages are 1) the zener diode (ZD101) and (ZD102) can be protected from reverse current; 2) both the diode (CR201) and the zener diode (ZD101) as well as both the diode (CR202) and the zener diode (ZD102) have temperature compensation effect.

Figure 8:
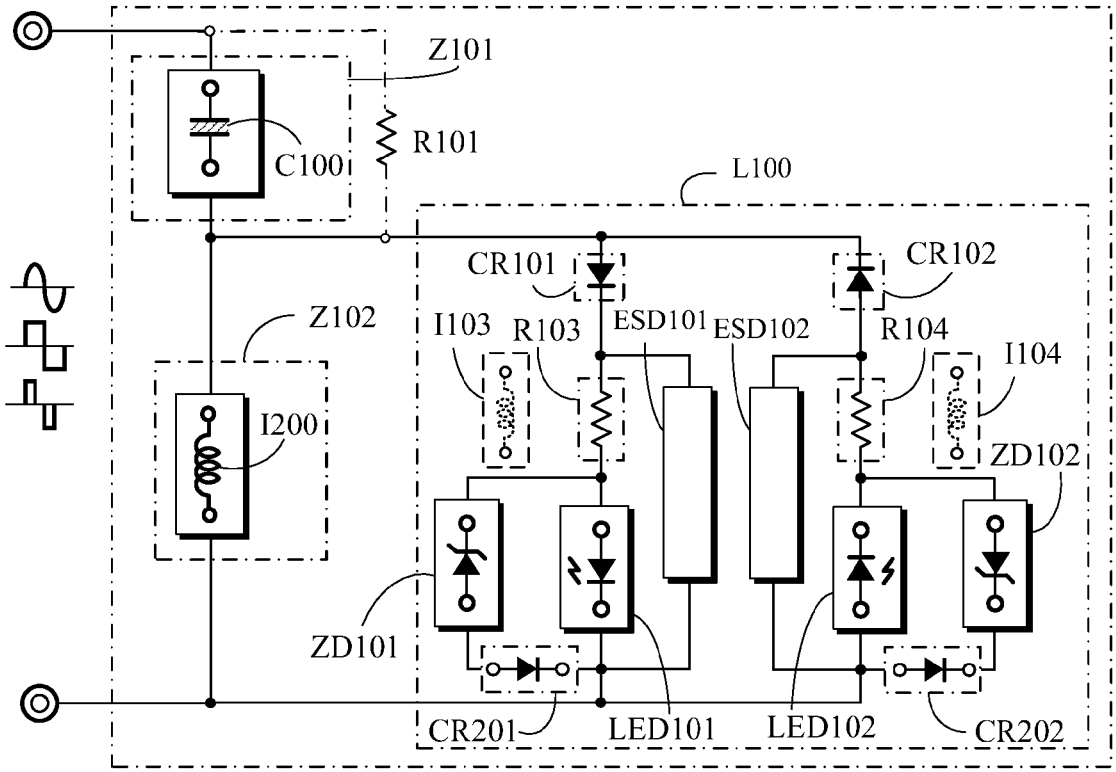
FIG. 8 is a circuit example schematic diagram illustrating that the charge/discharge device is parallel connected across the two ends of a light emitting diode and a current limit resistor in series connection in the circuit of FIG. 5.
Figure 9:
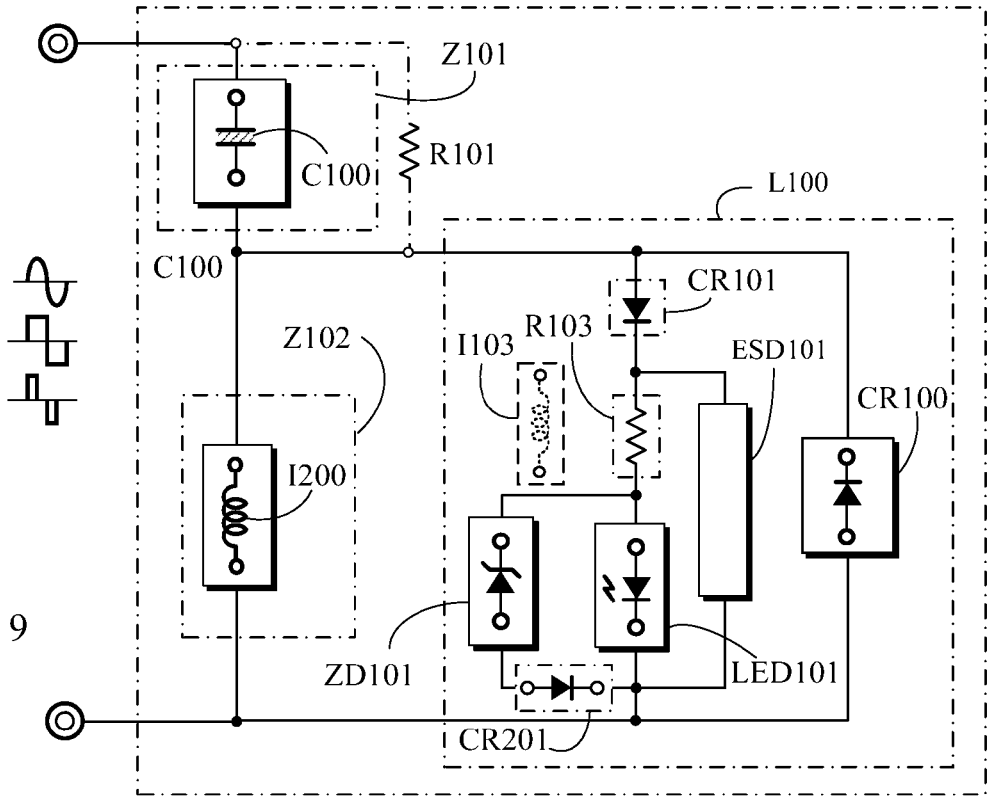
FIG. 9 is a circuit example schematic diagram illustrating that the charge/discharge device is parallel connected across the two ends of a light emitting diode and a current limit resistor in series connection in the circuit of FIG. 6.
Figure 10:
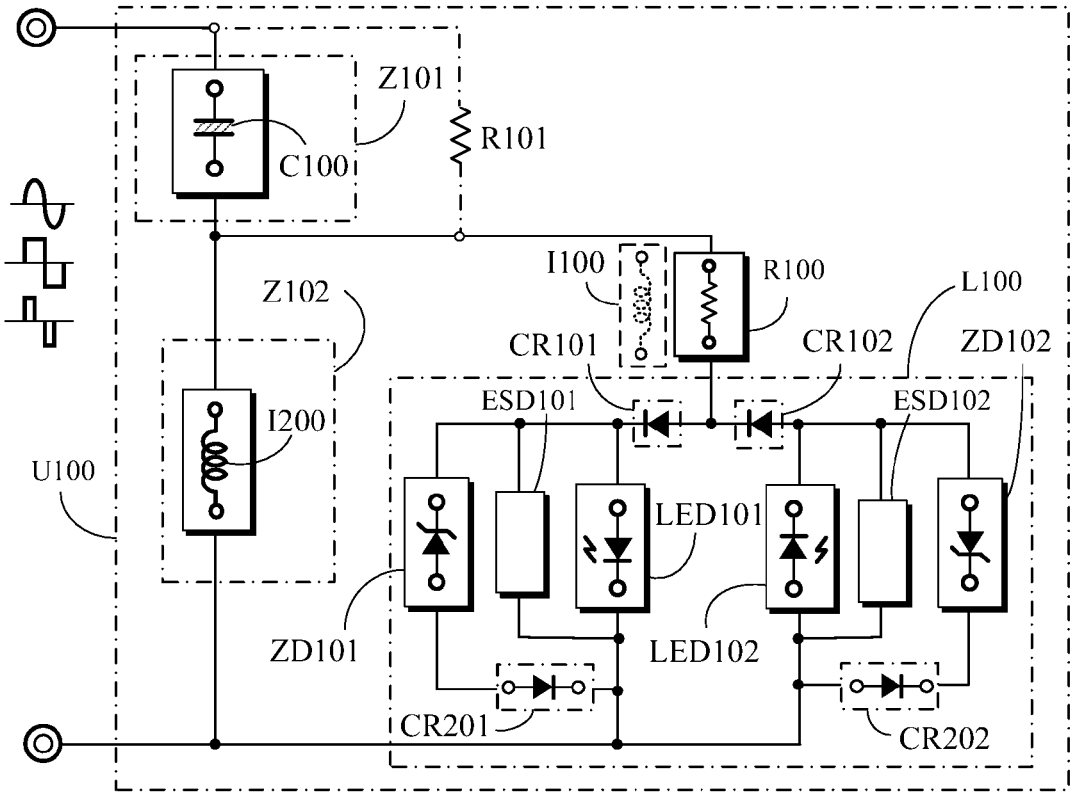
FIG. 10 is a circuit example schematic diagram illustrating that the light emitting diode in the circuit of FIG. 7 is parallel connected with a charge/discharge device.

The bi-directional light emitting diode drive circuit (U100) of the bi-directional light emitting diode drive circuit in bi-directional power series resonance as shown in the circuit examples of FIGS. 8, 9 and 10, whereof to promote the lighting stability of the light source produced by the light emitting diode, the first light emitting diode (LED101) can be installed with a charge/discharge device (ESD101), or the second light emitting diode (LED102) can be installed with a charge/discharge device (ESD102), whereof the charge/discharge device (ESD101) and the charge/discharge device (ESD102) have the random charging or discharging characteristics which can stabilize the lighting stability of the first light emitting diode (LED101) and the second light emitting diode (LED102), whereby to reduce their lighting pulsations. The aforesaid charge/discharge devices (ESD101), (ESD102) can be constituted by various conventional charging and discharging batteries, or super-capacitors or capacitors, etc;

The bi-directional light emitting diode drive circuit in bi-directional power series resonance can be further optionally installed with a charge/discharge device as needed, whereof it includes:

1. The bi-directional light emitting diode drive circuit in bi-directional power series resonance, whereof in its bi-directional light emitting diode drive circuit (U100), a charge/discharge device (ESD101) can be parallel connected across the two ends of the current limit resistor (R103) and the first light emitting diode (LED101) in series connection;

Or a charge/discharge device (ESD102) can be further parallel connected across the two ends of the current limit resistor (R104) and the second light emitting diode (LED102) in series connection;

FIG. 8 is a circuit example schematic diagram illustrating that a charge/discharge device is parallel connected across the two ends of the first light emitting diode, the second light emitting diode and the current limit resistor in series connection in the circuit of FIG. 5, whereof it is comprised of:

A charge/discharge device (ESD101) based on its polarity is parallel connected across the two ends of the first light emitting diode (LED101) and the current limit resistor (R103) in series connection, or is directly parallel connected across the two ends of the first light emitting diode (LED101), whereof the charge/discharge device (ESD101) has the random charge/discharge characteristics to stabilize the lighting operation and to reduce the lighting pulsation of the first light emitting diode (LED101);

If the second light emitting diode (LED102) is selected to use, a charge/discharge device (ESD102) based on its polarity is parallel connected across the two ends of the second light emitting diode (LED102) and the current limit resistor (R104) in series connection, whereof the charge/discharge device (ESD102) has the random charge/discharge characteristics to stabilize the lighting operation and to reduce the lighting pulsation of the second light emitting diode (LED102);

The aforesaid charge/discharge devices (ESD101), (ESD102) can be constituted by various conventional charging and discharging batteries, or super-capacitors or capacitors, etc.

2. The bi-directional light emitting diode drive circuit in bi-directional power series resonance, whereof if a first light emitting diode (LED101) is selected and is reversely parallel connected with a diode (CR100) in the bi-directional light emitting diode drive circuit (U100), then its main circuit structure is as shown in FIG. 9 which is a circuit example schematic diagram illustrating that a charge/discharge device is parallel connected across the two ends of the light emitting diode and the current limit resistor in series connection in the circuit of FIG. 6, whereof a charge/discharge device (ESD101) based on its polarity is parallel connected across the two ends of the first light emitting diode (LED101) and the current limit resistor (R103) in series connection, whereof the charge/discharge device (ESD101) has the random charge/discharge characteristics to stabilize the lighting operation and to reduce the lighting pulsation of the first light emitting diode (LED101);

The aforesaid charge/discharge devices (ESD101), (ESD102) can be constituted by various conventional charging and discharging batteries, or super-capacitors or capacitors, etc.

3. In the bi-directional light emitting diode drive circuit (U100) of the bi-directional light emitting diode drive circuit in bi-directional power series resonance of present invention, when the current limit resistor (R100) is selected to replace the current limit resistors (R103), (R104) for the common current limit resistor of the bi-directional conducting light emitting diode set (L100), or the current limit resistors (R103), (R104) and (R100) are not installed, the main circuit structure is as shown in FIG. 10 which is a circuit example schematic diagram illustrating that a charge/discharge device is parallel connected across the two ends of the light emitting diode and the current limit resistor in series connection in the circuit of FIG. 7, whereof it is comprised of that:

A charge/discharge device (ESD101) is directly parallel connected across the two ends of the first light emitting diode (LED101) of the same polarity, and a charge/discharge device (ESD102) is directly parallel connected across the two ends of the second light emitting diode (LED102) of the same polarity, whereof the charge/discharge devices (ESD101) and (ESD102) has the random charge or discharge characteristics;

The aforesaid charge/discharge devices (ESD101), (ESD102) can be constituted by various conventional charging and discharging batteries, or super-capacitors or capacitors, etc.

If the charge/discharge devices (ESD101) or (ESD102) used is uni-polar in its bi-directional light emitting diode drive circuit (U100) of the bi-directional light emitting diode drive circuit in bi-directional power series resonance, then after the first light emitting diode (LED101) is parallel connected with the uni-polar charge/discharge device (ESD101), a series connected diode (CR101) of forward polarity can be optionally installed as needed to prevent reverse voltage from damaging the uni-polar charge/discharge device; whereof after the second light emitting diode (LED102) is parallel connected with the uni-polar charge/discharge device (ESD102), a series connected diode (CR102) of forward polarity can be optionally installed as needed to prevent reverse voltage from damaging the uni-polar charge/discharge device;

The aforesaid charge/discharge devices (ESD101), (ESD102) can be constituted by various conventional charging and discharging batteries, or super-capacitors or capacitors, etc.

Figure 11:
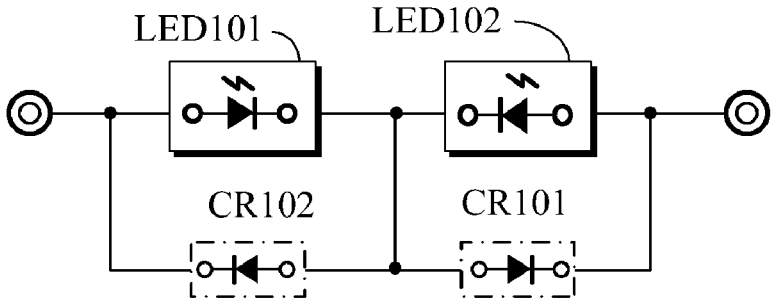
FIG. 11 is a circuit example schematic diagram of the bi-directional conducting light emitting diode set of the present invention illustrating that the first light emitting diode is reversely parallel connected with a diode, and the second light emitting diode is reversely parallel connected with a diode, whereby the two are series connected in opposite directions.
Figure 12:
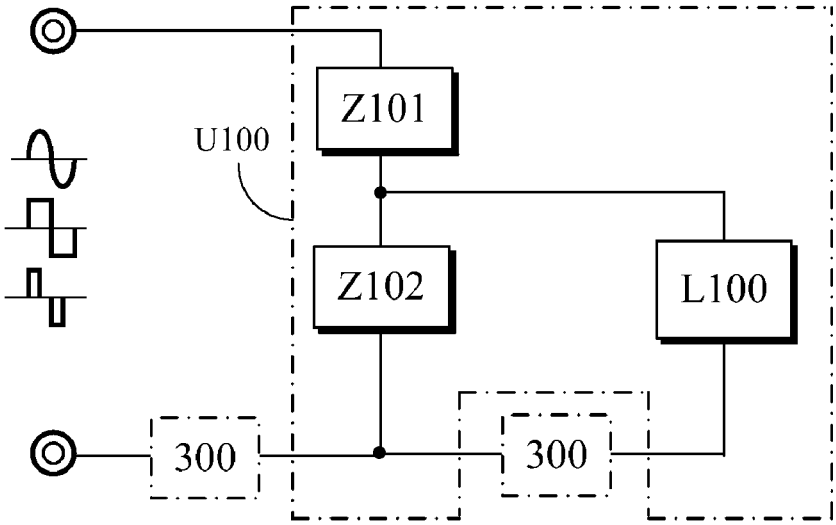
FIG. 12 is a circuit example schematic block diagram of the present invention which is series connected to the bi-directional power modulator of series connection type.
Figure 13:
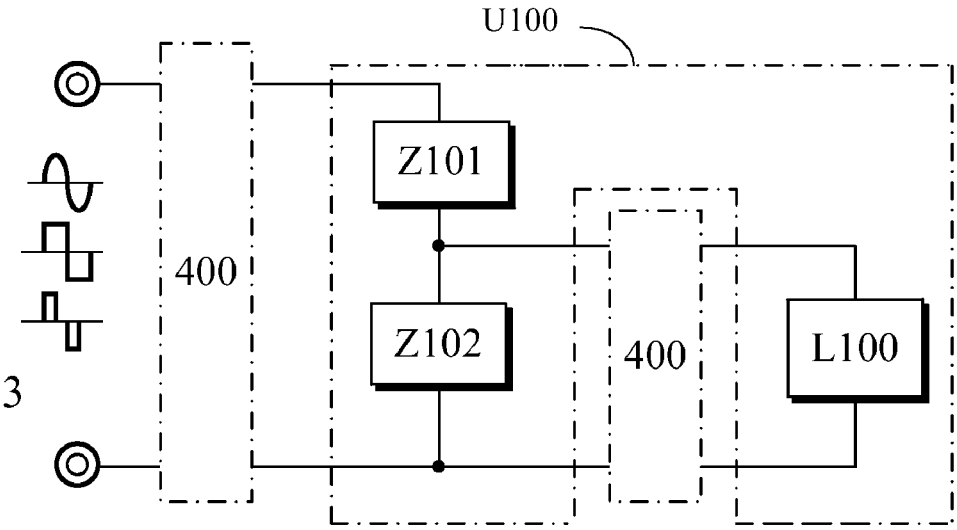
FIG. 13 is a circuit example schematic block diagram of the present invention which is parallel connected to the bi-directional power modulator of parallel connection type.

The aforesaid bi-directional conducting light emitting diode set (L100), in which the lighting functions of the said bi-directional light emitting diodes are constituted by the following:

(1) It is constituted by at least one first light emitting diode (LED101) and at least one second light emitting diode (LED102) in parallel connection of opposite polarities;

(2) At least one first light emitting diode (LED101) is series connected with a diode (CR101) in forward polarity, and at least one second light emitting diode (LED102) is series connected with a diode (CR102) in forward polarity, thereby the two are further parallel connected in opposite polarities;

(3) A diode (CR101) is parallel connected with at least one first light emitting diode (LED101) in opposite polarities, and a diode (CR102) is parallel connected with at least one second light emitting diode (LED102) in opposite polarities, whereof the two are further series connected in opposite directions to constitute a bi-directional conducting light emitting diode set (L100), whereof it is as shown in FIG. 11 which is a circuit example schematic diagram of the bi-directional conducting light emitting diode set of the present invention illustrating that the first light emitting diode is reversely parallel connected with a diode, and the second light emitting diode is reversely parallel connected with a diode, whereby the two are series connected in opposite directions;

(4) Or it can be constituted by conventional circuit combinations or components which allows the light emitting diode to receive power and to emit light bi-directionally;

The first impedance (Z101), the second impedance (Z102), the bi-directional conducting light emitting diode set (L100), the first light emitting diode (LED101), the second light emitting diode (LED102) and the various aforesaid optional auxiliary circuit components shown in the circuit examples of FIGS. 1~11 are based on application needs, whereof they can be optionally installed or not installed as needed and the installation quantity include constitution by one, wherein if more than one are selected in the application, the corresponding polarity relationship shall be determined based on circuit function requirement to execute series connection, or parallel connection or series and parallel connections; thereof it is constituted as the following:

1. The first impedance (Z101) can be constituted by a capacitor (C100) or by more than one capacitors (C100) in series connection, parallel connection or series and parallel connection;

2. The second impedance (Z102) can be constituted by an inductive impedance component (I200) or by more than one inductive impedance components (I200) in series connection, parallel connection or series and parallel connection;

3. The first light emitting diode (LED101) can be constituted by one light emitting diode, or by more than one light emitting diodes in series connection of forward polarity, or in parallel connection of the same polarity, or in series and parallel connection;

4. The second light emitting diode (LED102) can be constituted by one light emitting diode, or by more than one light emitting diodes in series connection of forward polarity, or in parallel connection of the same polarity, or in series and parallel connection;

5. In the bi-directional light emitting diode drive circuit (U100):

(1) It can be optionally installed with one bi-directional conducting light emitting diode set (L100) or with more than one bi-directional conducting light emitting diode sets (L100) in series connection, or in parallel connection, or in series and parallel connection, whereof if one set or more than one sets are selected to be installed, they can be driven together by the divided power at a common second impedance (Z102) or driven individually by the corresponding divided power at each of the multiple second impedances (Z102) which are in series connection or parallel connection;

(2) If a charge/discharge device (ESD101) or (ESD102) is installed in the bi-directional light emitting diode drive circuit (U100), then the light emitting diode (LED101) or (LED102) of the bi-directional conducting light emitting diode set (L100) is driven by DC power to emit light continuously;

If the charge/discharge device (ESD101) or (ESD102) is not installed, then current conduction to the light emitting diode (LED101) or (ESD102) is intermittent, whereby referring to the input voltage wave shape and duty cycle of current conduction, the light emitting forward current and the peak of light emitting forward voltage of each light emitting diode in the bi-directional conducting light emitting diode set (L100) can be correspondingly selected for the light emitting diode (LED101) or (LED102), whereof the selections include the following:

(1) The light emitting peak of forward voltage is lower than the rated forward voltage of light emitting diode (LED101) or (LED102); or (2) The rated forward voltage of light emitting diode (LED101) or (LED102) is selected to be the light emitting peak of forward voltage; or (3) If current conduction to the light emitting diode (LED101) or (LED102) is intermittent, the peak of light emitting forward voltage can be correspondingly selected based on the duty cycle of current conduction as long as the principle of that the peak of light emitting forward voltage does not damage the light emitting diode (LED101) or (LED102) is followed;

(4) Based on the value and wave shape of the aforesaid light emitting forward voltage, the corresponding current value and wave shape from the forward voltage vs. forward current ratio are produced; however the peak of light emitting forward current shall follow the principle not to damage the light emitting diode (LED101) or (LED102);

(5) The luminosity or the stepped or step-less luminosity modulation of the forward current vs. relative luminosity can be controlled based on the aforesaid value and wave shape of forward current;

6. The diode (CR100), (CR101), (CR102), (CR201) and (CR202) can be constituted by one diode, or by more than one diodes in series connection of forward polarity, or in parallel connection of the same polarity, or in series and parallel connection, whereof said diodes can be optionally installed as needed;

7. The discharge resistor (R101) and the current limit resistors (R100), (R103), (R104) can be constituted by one resistor, or by more than one resistors in series connection or parallel connection or series and parallel connection, whereof said resistors can be optionally installed as needed;

8. The inductive impedance components (I100), (I103), (I104) can be constituted by one inductive impedance component, or by more than one inductive impedance components in series connection or parallel connection or series and parallel connection, whereof said impedance components can be optionally installed as needed;

9. The zener diodes (ZD101), (ZD102) can be constituted by one zener diode, or by more than one zener diodes in series connection of forward polarity, or in parallel connection of the same polarity, or in series and parallel connection, whereof said zener diodes can be optionally installed as needed;

10. The charge/discharge device (ESD101), (ESD102) can be constituted by one, or by more than ones in series connection of forward polarity, or in parallel connection of the same polarity, or in series and parallel connection, whereof said charge/discharge devices can be optionally installed as needed;

In the application of the bi-directional light emitting diode drive circuit of the bi-directional power in series resonance of present invention, the following different types of bi-directional AC power can be provided for inputs, whereof the bi-directional power includes that:

(1) The AC power with a constant or variable voltage and a constant or variable frequency; or (2) The AC power of bi-directional sinusoidal wave voltage or bi-directional square wave voltage, or bi-directional pulse wave voltage with constant or variable voltage and constant or variable frequency or period which is converted from a DC power source; or (3) The AC power of bi-directional sinusoidal wave voltage or bi-directional square wave voltage, or bi-directional pulse wave voltage with constant or variable voltage and constant or variable frequency or period converted from the DC power which is further rectified from an AC power;

The bi-directional light emitting diode drive circuit in bi-directional power series connection of present invention can be further optionally combined with the following active modulating circuit devices as needed, whereof the applied circuits are the following 1. FIG. 12 is a circuit example schematic block diagram of the present invention which is series connected to the bi-directional power modulator of series connection type, whereof the bi-directional power modulator of series connection type is constituted by the following:

A bi-directional power modulator of series connection type (300): It is constituted by the conventional electromechanical components or solid state power components and related electronic circuit components to modulate the bi-directional power output;

The circuit operating functions are the following:

(1) The bi-directional power modulator of series connection type (300) can be optionally installed as needed to be series connected with the bi-directional light emitting diode drive circuit (U100) to receive the bi-directional power from power source, whereby the bi-directional power is modulated by the bi-directional power modulator of series connection type (300) to execute power modulations such as pulse width modulation or current conduction phase angle control, or impedance modulation, etc. to drive the bi-directional light emitting diode drive circuit (U100); or (2) The bi-directional power modulator of series connection type (300) can be optionally installed as needed to be series connected between the second impedance (Z102) and the bi-directional conducting light emitting diode set (L100) whereby the bi-directional divided power across the two ends of the second impedance (Z102) is modulated by the bi-directional power modulator of series connection type (300) to execute power modulations such as pulse width modulation or current conduction phase angle control, or impedance modulation, etc. to drive the bi-directional conducting light emitting diode set (L100);

2. FIG. 13 is a circuit example schematic block diagram of the present invention which is parallel connected to a bi-directional power modulator of parallel connection type, whereof the bi-directional power modulator of parallel connection type is constituted by the following:

A bi-directional power modulator of parallel connection type (400): It is constituted by the conventional electromechanical components or solid state power components and related electronic circuit components to modulate the bi-directional power output.

Figure 14:
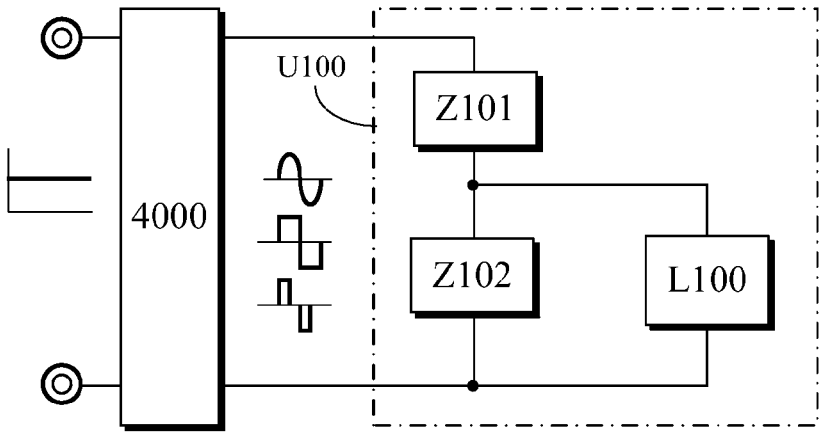
FIG. 14 is a circuit example schematic block diagram of the present invention driven by the DC to AC inverter output power.

The circuit operating functions are the following:

(1) The bi-directional power modulator of parallel connection type (400) can be optionally installed as needed, whereof its output ends are for parallel connection with the bi-directional light emitting diode drive circuit (U100), while its input ends are provided for receiving the bi-directional power from the power source, whereby the bi-directional power is modulated by the bi-directional power modulator of parallel connection type (400) to execute power modulations such as pulse width modulation or current conduction phase angle control, or impedance modulation, etc. to drive the bi-directional light emitting diode drive circuit (U100); or (2) The bi-directional power modulator of parallel connection type (400) can be optionally installed as needed, whereof its output ends are parallel connected with the input ends of the bi-directional conducting light emitting diode set (L100)

while its input ends are parallel connected across the two ends of the second impedance (Z102), whereby the bi-directional divided power across the two ends of the second impedance (Z102) is modulated by the bi-directional power modulator of parallel connection type (400) to execute power modulations such as pulse width modulation or current conduction phase angle control, or impedance modulation, etc. to drive the bi-directional conducting light emitting diode set (L100);

3. FIG. 14 is a circuit example schematic block diagram of the present invention driven by the power outputted from a DC to AC inverter;

It is mainly comprised of that:

A DC to AC Inverter (4000): it is constituted by the conventional electromechanical components or solid state power components and related electronic circuit components, whereof its input ends are optionally provided as needed to receive input from a constant or variable voltage DC power, or a DC power rectified from an AC power, while its output ends are optionally selected as needed to supply a bi-directional AC power of bi-directional sinusoidal wave, or bi-directional square wave or bi-directional pulse wave with constant or variable voltage and constant or variable alternated polarity frequency or periods to be used as the power source to supply bi-directional power;

The circuit operating functions are the following:

The bi-directional light emitting diode drive circuit (U100) is parallel connected across the output ends of the conventional DC to AC inverter (4000); the input ends of the DC to AC inverter (4000) are optionally provided as needed to receive input from a constant or variable voltage DC power, or a DC power rectified from an AC power;

The output ends of the DC to AC inverter (4000) can be optionally selected as needed to provide the bi-directional sinusoidal wave, or bi-directional square wave, or bi-directional pulse wave power with constant or variable voltage and constant or variable alternated periods, whereof it can be further supplied to the two ends of the first impedance (Z101) and the second impedance (Z102) in series connection of the bi-directional light emitting diode drive circuit (U100), whereof the divided power across the two ends of the second impedance (Z102) is used to drive the bi-directional conducting light emitting diode set (L100);

In addition, the bi-directional light emitting diode drive circuit (U100) in series resonance can be controlled and driven by means of modulating the output power from the DC to AC inverter (4000), as well as by executing power modulations to the power outputted such as pulse width modulation, or current conduction phase angle control, or impedance modulation, etc.;

4. The bi-directional light emitting diode drive circuit (U100) is arranged to be series connected with a least one conventional impedance component (500) and to be further parallel connected with the power source, whereof the impedance (500) includes that:

(1) An impedance component (500): it is constituted by a component with resistive impedance characteristics; or (2) An impedance component (500): it is constituted by a component with inductive impedance characteristics; or (3) An impedance component (500): it is constituted by a component with capacitive impedance characteristics; or (4) An impedance component (500): it is constituted by a single impedance component with the combined impedance characteristics of at least two of the resistive impedance, or inductive impedance, or capacitive impedance simultaneously, thereby to provide DC or AC impedances; or (5) An impedance component (500): it is constituted by a single impedance component with the combined impedance characteristics of inductive impedance and capacitive impedance, whereof its inherent parallel resonance frequency is the same as the frequency or period of bi-directional power from power source, thereby to produce a parallel resonance status; or (6) An impedance component (500): it is constituted by one kind or more than one kind of one or more than one capacitive impedance component, or inductive impedance component, or resistive impedance component, or by two kinds or more than two kinds of impedance components in series connection, or parallel connection, or series and parallel connection so as to provide DC or AC impedances; or (7) An impedance component (500): it is constituted by the mutual series connection of a capacitive impedance component and an inductive impedance component, whereof its inherent series resonance frequency is the same as the frequency or period of bi-directional power from power source, thereby to produce a series resonance status and the end voltage across two ends of the capacitive impedance component or the inductive impedance component appear in series resonance correspondingly;

Or the capacitive impedance and the inductive impedance are in mutual parallel connection, whereby its inherent parallel resonance frequency is the same as the frequency or period of bi-directional power from power source, thereby to produce a parallel resonance status and appear the corresponding end voltage.

Figure 15:
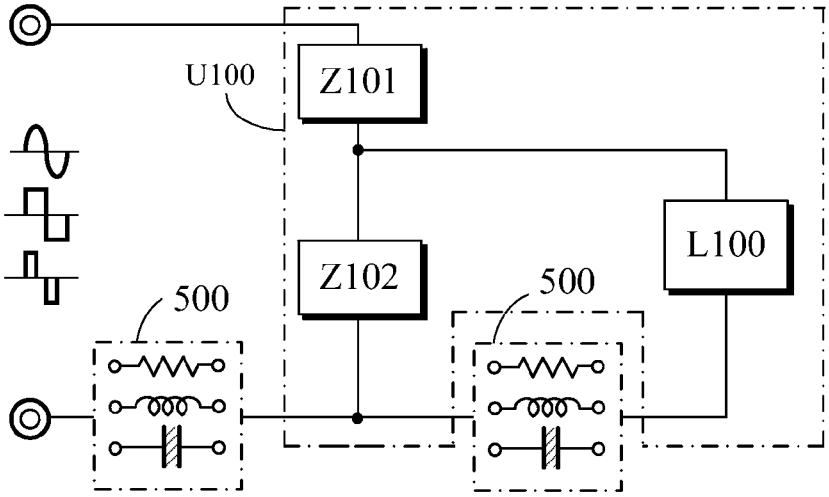
FIG. 15 is a circuit example schematic block diagram of the present invention which is series connected with impedance components.
Figure 16:
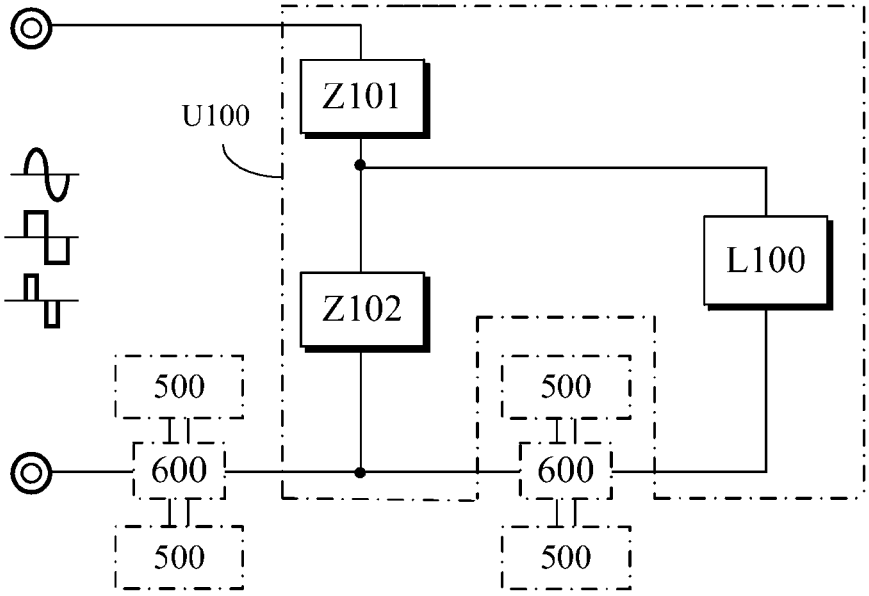
FIG. 16 is a circuit example schematic block diagram of the present invention illustrating that the impedance components in series connection execute series connection, or parallel connection, or series and parallel connection by means of the switching device.

FIG. 15 is a circuit example schematic block diagram of the present invention which is series connected with impedance components;

5. At least two impedance components (500) as said in the item 4 execute switches between series connection, parallel connection and series and parallel connection bye means of the switching device (600) which is constituted by electromechanical components or solid state components, whereby to modulate the power transmitted to the bi-directional light emitting diode drive circuit (U100), wherein FIG. 16 is a circuit example schematic block diagram of the present invention illustrating that the impedance components in series connection execute series connection, or parallel connection, or series and parallel connection by means of the switching device.

The bi-directional light emitting diode drive circuit of bi-directional power in series resonance, in which the optionally installed inductive impedance component (I200) of the second impedance (Z102) can be further replaced by the power supply side winding of a transformer with inductive effect, whereof the transformer can be a self-coupled transformer (ST200) with self-coupled voltage change winding or a transformer (IT200) with separating type voltage change winding.

Figure 17:
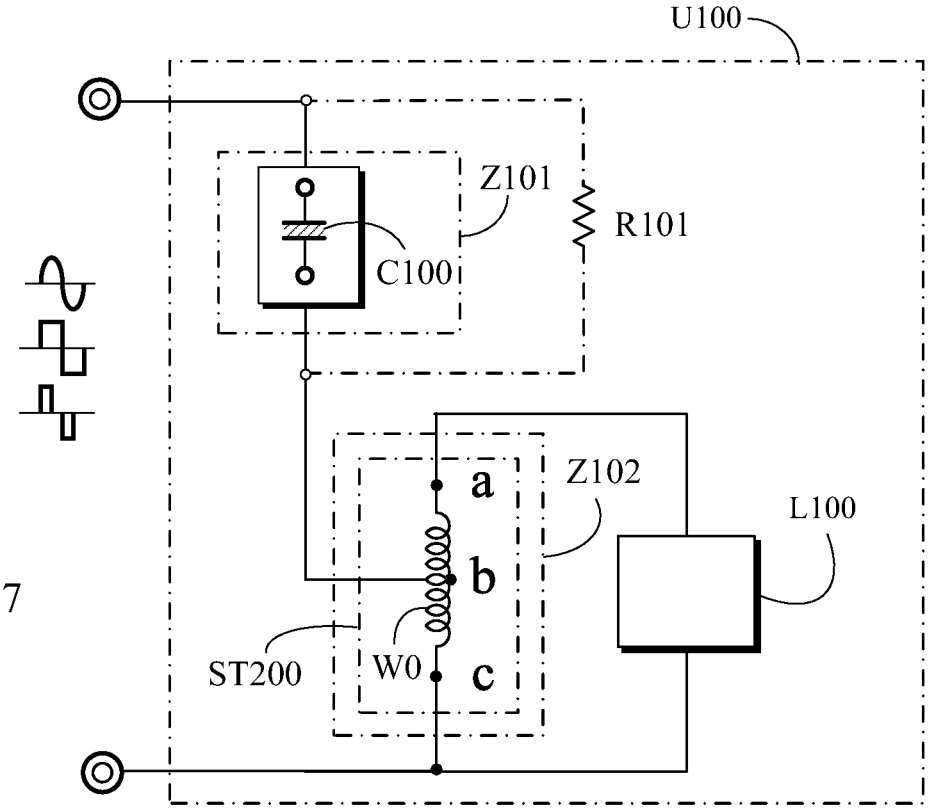
FIG. 17 is a circuit example schematic diagram of the present invention illustrating that the inductive impedance component of the second impedance is replaced by the self-coupled voltage change power supply side winding of the self-coupled transformer thereby to constitute a voltage rise.
Figure 18:
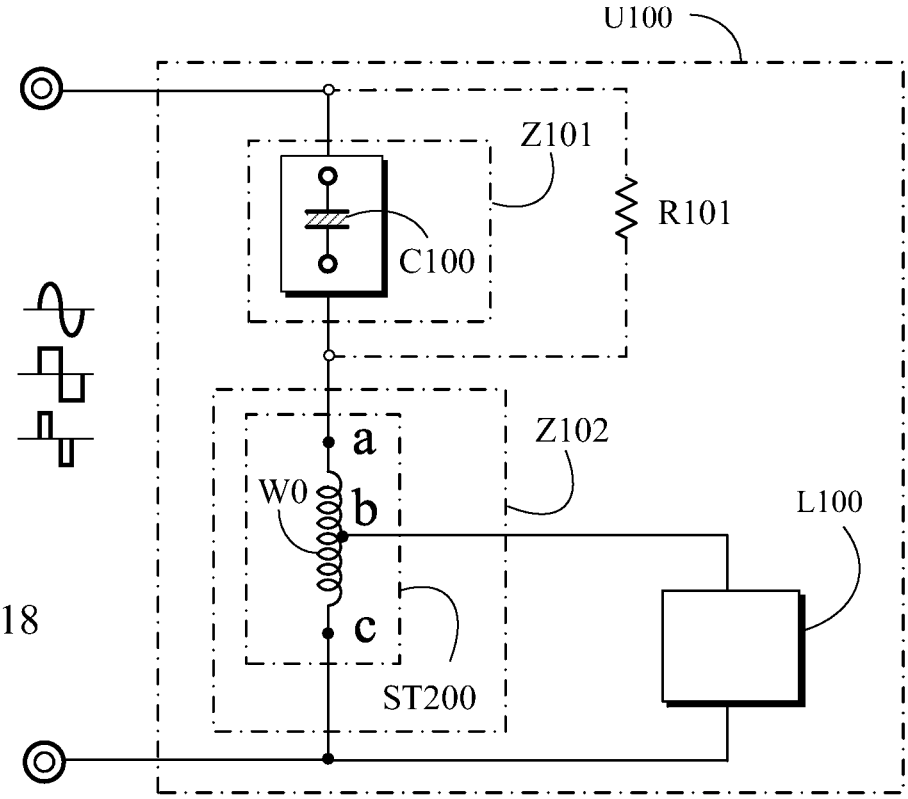
FIG. 18 is a circuit example schematic diagram of the present invention illustrating that the inductive impedance component of the second impedance is replaced by the self-coupled voltage change power supply side winding of the self-coupled transformer thereby to constitute a voltage drop.
Figure 19:
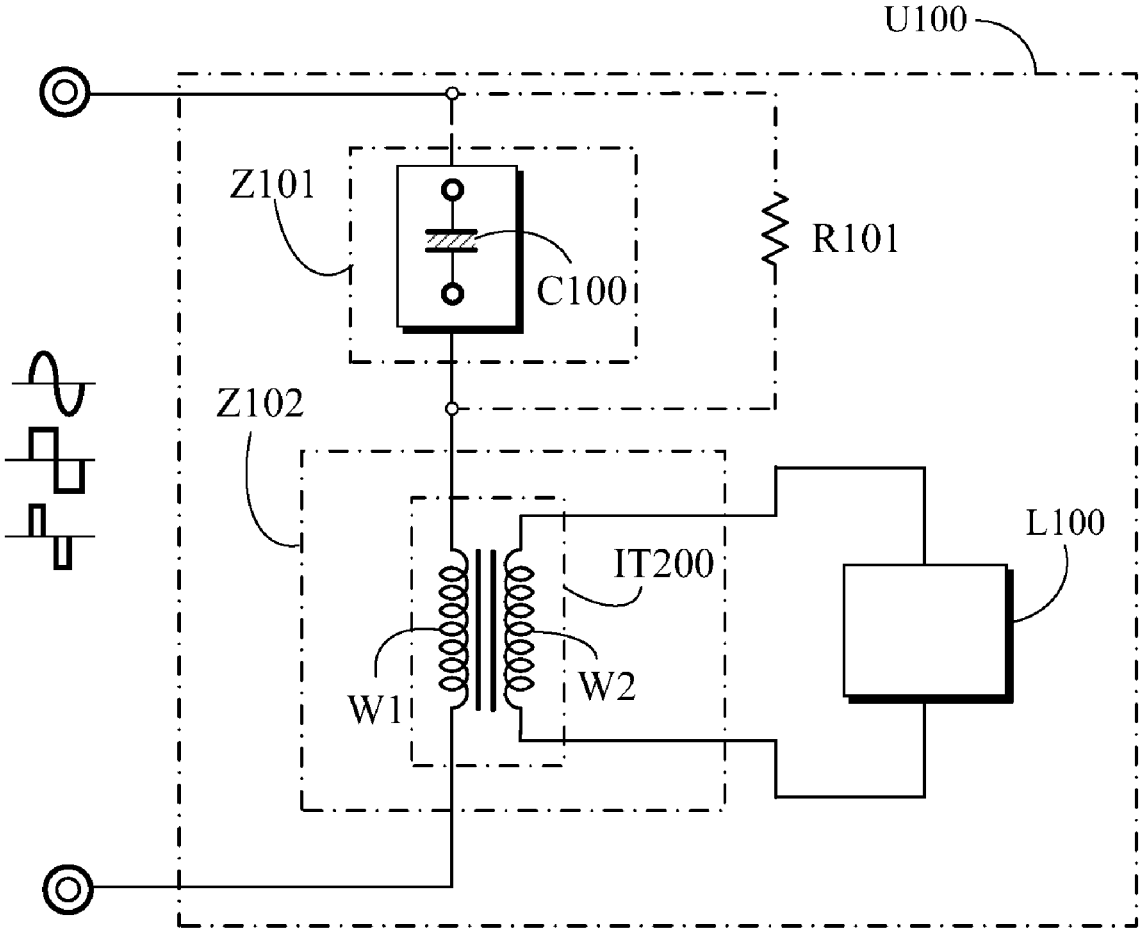
FIG. 19 is a circuit example schematic diagram of the present invention illustrating that the inductive impedance component of the second impedance is replaced by the primary side winding of the separating type transformer with separating type voltage change winding.

FIG. 17 is a circuit example schematic diagram of the present invention illustrating that the inductive impedance component of the second impedance is replaced by the self-coupled voltage change power supply side winding of the self-coupled transformer thereby to constitute a voltage rise, whereof as shown in FIG. 17, the self-coupled transformer (ST200) has a self-coupled voltage change winding (W0) with a voltage raising function, the b, c ends of the self-coupled voltage change winding (W0) of the self-coupled transformer (ST200) are the power supply side which replace the inductive impedance component (I200) of the second impedance (Z102) to constitute a second impedance (Z102), which is further series connected with the capacitor (C100) of the first impedance (Z101), whereof their inherent series resonance frequency is the same as the frequency of the AC power source, or the period of the constant or variable periodically alternated polarity power, thereby to produce a series resonance status; whereof the a, c output ends of the self-coupled voltage change winding (W0) of the self-coupled transformer (ST200) are arranged to provide AC power of voltage rise to drive the bi-directional conducting light emitting diode set (L100);

FIG. 18 is a circuit example schematic diagram of the present invention illustrating that the inductive impedance component of the second impedance is replaced by the self-coupled voltage change power supply side winding of the self-coupled transformer thereby to constitute a voltage drop, whereof as shown in FIG. 18, the self-coupled transformer (ST200) has a self-coupled voltage change winding (W0) with voltage drop function, in which the a, c ends of the self-coupled voltage change winding (W0) of the self-coupled transformer (ST200) are the power supply side which replace the inductive impedance component (I200) of the second impedance (Z102) to constitute a second impedance (Z102), which is series connected with the capacitor (C100) of the first impedance (Z101), whereof their inherent series resonance frequency is the same as the frequency of the AC power source, or the period of the constant or variable periodically alternated polarity power, thereby to produce a series resonance status; whereof the b, c output ends of the self-coupled voltage change winding (W0) of the self-coupled transformer (ST200) are arranged to provide AC power of voltage drop to drive the bi-directional conducting light emitting diode set (L100);

FIG. 19 is a circuit example schematic diagram of the present invention illustrating that the inductive impedance component of the second impedance is replaced by the primary side winding of the separating type transformer with separating type voltage change winding, whereof as shown in FIG. 19, the separating type transformer (IT200) is comprised of a primary side winding (W1) and secondary side winding (W2), in which the primary side winding (W1) and secondary side winding (W2) are separated, whereof the primary side winding (W1) constitute a second impedance (Z102) which is series connected with the capacitor (C100) of the first impedance (Z101), whereof their inherent series resonance frequency produces a series resonance status with the frequency of the AC power source, or the period of the constant or variable periodically alternated polarity power, whereof the output voltage of the secondary side winding (W2) of the separating type transformer (IT200) can be optionally selected as needed to provide AC power of voltage rise or voltage drop to drive the bi-directional conducting light emitting diode set (L100).

Through the above description, the inductive impedance component (I200) of the second impedance (Z102) is replaced by the power supply side winding of the transformer while the secondary side of the separating type transformer (IT200) provides AC power of voltage rise or voltage drop to drive the bi-directional conducting light emitting diode set (L100).

Color of the individual light emitting diodes (LED101) of the bi-directional conducting light emitting diode set (L100) in the bi-directional light emitting diode drive circuit (U100) of the bi-directional light emitting diode drive circuit in bi-directional power series resonance can be optionally selected to be constituted by one or more than one colors.

The relationships of location arrangement between the individual light emitting diodes (LED101) of the bi-directional conducting light emitting diode set (L100) in the bi-directional light emitting diode drive circuit (U100) of the bi-directional light emitting diode drive circuit in bi-directional power series resonance include the following: 1) sequentially linear arrangement; 2) sequentially distributed in a plane; 3) crisscross-linear arrangement; 4) crisscross distribution in a plane; 5) arrangement based on particular geometric positions in a plane; 6) arrangement based on 3D geometric position.

The bi-directional light emitting diode drive circuit in bi-directional power series resonance of the present invention, in which the embodiments of its bi-directional light emitting diode drive circuit (U100) are constituted by circuit components which include: 1) It is constituted by individual circuit components which are inter-connected; 2) At least two circuit components are combined to at least two partial functioning units which are further inter-connected; 3) All components are integrated together to one structure.

As is summarized from above descriptions, progressive performances of power saving, low heat loss and low cost can be provided by the bi-directional light emitting diode drive circuit in bi-directional power series resonance of the present invention through the charging/discharging by the uni-polar capacitor to drive the light emitting diode.

The invention claimed is:

1. A bi-directional light emitting diode drive circuit in bi-directional power series resonance, which uses capacitive impedance component to be a first impedance and inductive impedance component to be a second impedance, wherein the inherent series resonance frequency of the first impedance and the second impedance in series connection is the same as the frequency of the bi-directional AC power source, or the alternated polarity period of the constant or variable voltage converted from a DC power and the constant or variable periodically alternated polarity power, thereby to produce a series resonance status; wherein in series resonance, a bi-directional divided power in series resonance is formed across the two ends of the capacitive impedance component or the inductive impedance component for driving at least one bi-directional conducting light emitting diode which is parallel connected across the two ends of the first impedance or the second impedance to emit light;

a bi-directional light emitting diode drive circuit (U100) in bi-directional power series resonance, in which the first impedance includes capacitive impedance components and the second impedance includes inductive impedance components, wherein at least one first light emitting diode is reversely parallel connected with a second light emitting diode to constitute at least one bi-directional conducting light emitting diode set which is parallel connected across the two ends of at least one first impedance or at least one second impedance, while the first impedance and the second impedance in series connection is provided for inputting:

1) AC power with a constant or variable voltage and a constant or variable frequency; or 2) AC power of bi-directional sinusoidal wave voltage or bi-directional square wave voltage, or bi-directional pulse wave voltage with constant or variable voltage and constant or variable frequency or period which is converted from the DC power source; or 3) AC power of bi-directional sinusoidal wave voltage or bi-directional square wave voltage, or bi-directional pulse wave voltage with constant or variable voltage and constant or variable frequency or period converted from the DC power which is further rectified from the AC power;

the bi-directional divided power in series resonance formed at the first impedance or the second impedance in series resonance is used to drive the at least one bi-directional conducting light emitting diode set which is parallel connected across the two ends of either the first impedance or the second impedance, or at least two bi-directional conducting light emitting diodes which are respectively parallel connected across the two ends of the first impedance and the second impedance to be respectively driven by the divided power across the two ends of the first impedance and the two ends of the second impedance, thereby to constitute the bi-directional light emitting diode drive circuit in bi-directional power series resonance of the present invention; comprising:

the first impedance (Z101) is comprised of:

at least one capacitive impedance component, or two or more than two capacitive impedance components in series connection or parallel connection or series and parallel connection, or a capacitive impedance component, and it can be optionally installed as needed with one kind or more than one kind and one or more than one additional inductive impedance components or capacitive impedance components, or optionally installed as needed with two or more than two kinds of impedance components, wherein each kind of impedance components is constituted in series connection or parallel connection or series and parallel connection;

the second impedance (Z102) includes at least one inductive impedance component or two or more than two inductive impedance components in series connection, or parallel connection, or series and parallel connection, or at least one inductive impedance component, and it can be optionally installed as needed with one kind or more than one kind and one or more than one additional capacitive impedance components or resistive impedance components, or optionally installed as needed with two kinds or more than two kinds of impedance components, wherein each kind of impedance components is constituted in series connection or parallel connection or series and parallel connection;

an inherent series resonance frequency of the first impedance component (Z101) and the second impedance (Z102) in series connection is the same as the frequency of the AC power from power source, or the period of the periodically alternated polarity DC power, thereby to produce a series resonance status, wherein in series resonance, the bi-directional power input is formed by the first impedance (Z101) and the second impedance (Z102) into the bi-directional divided power in series resonance, whereby the bi-directional conducting light emitting diode set (L100) which is parallel connected with the first impedance (Z101) or the second impedance (Z102) is driven by the said divided power to emit light;

a bi-directional conducting light emitting diode set (L100) includes at least one first light emitting diode (LED101) and the at least one second light emitting diode (LED102) in parallel connection of inverse polarities, wherein the number of first light emitting diodes (LED101) and the number of second light emitting diodes (LED102) can be the same or different, and the first light emitting diode (LED101) and the second light emitting diode (LED102) include a forward current polarity light emitting diode, or by two or more than two forward current polarity light emitting diodes in series connection or parallel connection, or by three or more than three forward current polarity light emitting diodes in series connection, parallel connection or series and parallel connection;

the bi-directional conducting light emitting diode set (L100) can be optionally selected as needed to be parallel connected across the two ends of either the first impedance (Z101) or the second impedance (Z102), wherein the bi-directional divided power in series resonance is formed across the two ends of the first impedance (Z101) and the two ends of the second impedance (Z102) from power input, whereby the bi-directional conducting light emitting diode set (L100) which is parallel connected across the two ends of the first impedance (Z101) or the second impedance (Z102) is driven by the said divided power to emit light;

the bi-directional divided power in series resonance formed at the first impedance or the second impedance in series resonance by means of above said powers to drive at least one bi-directional conducting light emitting diode set which is parallel connected across the two ends of either the first impedance or the second impedance, or to drive at least two bi-directional conducting light emitting diode sets which are respectively parallel connected across the two ends of the first impedance and the second impedance, thereby to constitute the bi-directional light emitting diode drive circuit in bi-directional power series resonance of the present invention;

the bi-directional light emitting diode drive circuit in bi-directional power series resonance of the present invention, in which the first impedance (Z101) and the second impedance (Z102) as well as the bi-directional conducting light emitting diode set (L100) can be optionally selected to be one or more than one as needed;

the first impedance (Z101), the second impedance (Z102), the bi-directional conducting light emitting diode set (L100), the first light emitting diode (LED101), the second light emitting diode (LED102) and various optional auxiliary circuit components are based on application needs, wherein they can be optionally installed or not installed as needed and the installation quantity include constitution by one, wherein if more than one are selected in the application, the corresponding polarity relationship shall be determined based on circuit function requirement to execute series connection, or parallel connection or series and parallel connections.

2. A bi-directional light emitting diode drive circuit in bi-directional power series resonance as claimed in claim 1, comprising:

the first impedance (Z101) including at least one capacitive impedance component, especially by the capacitor (C100), wherein the number of the first impedance (Z101) can be one or more than ones;

the second impedance (Z102) including at least one inductive impedance component (I200), wherein the number of the second impedance (Z102) can be one or more than ones;

the first impedance (Z101) and the second impedance (Z102) are in series connection, wherein the two ends of them after series connection are provided for inputting:

1) AC power with a constant or variable voltage and a constant or variable frequency; or 2) AC power of bi-directional sinusoidal wave voltage or bi-directional square wave voltage, or bi-directional pulse wave voltage with constant or variable voltage and constant or variable frequency or period which is converted from a DC power source; or 3) AC power of bi-directional sinusoidal wave voltage or bi-directional square wave voltage, or bi-directional pulse wave voltage with constant or variable voltage and constant or variable frequency or period converted from the DC power which is further rectified from an AC power;

by means of above said power input, the bi-directional divided power in series resonance is formed at the first impedance and the second impedance in series connection, whereby at least one bi-directional conducting light emitting diode set (L100) is driven by the said divided power;

a series resonance frequency of the first impedance (Z101) and the second impedance (Z102) in series connection is the same as the frequency of AC power from power source or the period of periodically alternated polarity DC power, thereby to produce a series resonance status;

the bi-directional conducting light emitting diode set (L100) including at least one first light emitting diode (LED101) and at least one second light emitting diode (LED102) in parallel connection of inverse polarities, wherein the number of the first light emitting diode (LED101) and the number of the second light emitting diode (LED102) can be the same or different, further, the first light emitting diode (LED101) and the second light emitting diode (LED102) can include a forward current light emitting diode; or two or more than two forward current polarity light emitting diodes in series or parallel connections; or three or more than three forward current polarity light emitting diodes in series or parallel connections or in series and parallel connections; the bi-directional conducting light emitting diode set (L100) can be optionally installed with one or more than one sets as needed, wherein it is parallel connected across the two ends of both or either of the first impedance (Z101) or the second impedance (Z102) to form the divided power for driving the bi-directional conducting light emitting diode set (L100) which is parallel connected across the two ends of the first impedance (Z101) or the second impedance (Z102) to emit light; or the bi-directional conducting light emitting diode set (L100) is parallel connected to the two ends of at least one second impedance (Z102), i.e. it is parallel connected across the two ends of the inductive impedance component (I200) which constitutes the second impedance (Z102), thereby it is driven by the divided power across the two ends of the inductive impedance component (I200) while the impedance of the first impedance (Z101) is used to limit its current, wherein in case that the capacitor (C100) (such as a bipolar capacitor) is used as the first impedance component, the output current is limited by the capacitive impedance;

the first impedance (Z101), the second impedance (Z102) and the bi-directional conducting light emitting diode set (L100) are connected according to the aforesaid circuit structure to constitute the bi-directional light emitting diode drive circuit (U100).

3. A bi-directional light emitting diode drive circuit in bi-directional power series resonance as claimed in claim 1, wherein through the current distribution effect formed by the parallel connection of the bi-directional conducting light emitting diode set (L100) and the second impedance (Z102), the voltage variation rate across the two ends of the bi-directional conducting light emitting diode set (L100) corresponding to power source voltage variation can be reduced.

4. A bi-directional light emitting diode drive circuit in bi-directional power series resonance as claimed in claim 1, wherein either the first light emitting diode (LED101) or the second light emitting diode (LED102) can be replaced by a diode (CR100), wherein the current direction of the said (CR100) and the current direction of either the first light emitting diode (LED101) or the second light emitting diode (LED102) which is reserved for parallel connection are parallel connected of inverse polarity.

5. A bi-directional light emitting diode drive circuit in bi-directional power series resonance as claimed in claim 1, wherein if the first light emitting diode (LED101) and the second light emitting diode (LED102) of the bi-directional conducting light emitting diode set (L100) are installed with current limit resistors (R103) and (R104) simultaneously, they can be directly replaced by or installed together with series connecting a current limit resistor (R100) with the bi-directional conducting light emitting diode set (L100); further, the current limit resistor (R100) can also be replaced by the inductive impedance (I100);

the above said circuit structure and auxiliary circuit components are selected to constitute the bi-directional light emitting diode drive circuit (U100).

6. A bi-directional light emitting diode drive circuit in bi-directional power series resonance as claimed in claim 1, wherein a zener diode can be further parallel connected across the two ends of the first light emitting diode (LED101) or the second light emitting diode (LED102) in the bi-directional conducting light emitting diode set (L100), or the zener diode is first series connected with at least one diode to produce a zener voltage function, then parallel connected across the two ends of the first light emitting diode (LED101) or the second light emitting diode (LED102); comprising:

the zener diode (ZD101) is parallel connected across the two ends of the first light emitting diode (LED101) of the bi-directional conducting light emitting diode set (L100), wherein its polarity relationship is that the zener voltage of the zener diode (ZD101) is used to limit the working voltage across the two ends of the first light emitting diode (LED101);

said zener diode (ZD101) can be optionally series connected with a diode (CR201) as needed, the advantages are 1) the zener diode (ZD101) can be protected from reverse current; 2) both diode (CR201) and zener diode (ZD101) have temperature compensation effects;

if the second light emitting diode (LED102) is selected to consitute the bi-directional conducting light emitting diode set (L100), a zener diode (ZD102) can be selected to parallel connect across the two ends of the second light emitting diode (LED102), wherein their polarity relationship is that the zener voltage of the zener diode (ZD102) is used to limit the working voltage across the two ends of the second light emitting diode (LED102);

said zener diode (ZD102) can be optionally series connected with a diode (CR202) as needed, the advantages are 1) the zener diode (ZD102) can be protected from reverse current; 2) both diode (CR202) and zener diode (ZD102) have temperature compensation effects.

7. A bi-directional light emitting diode drive circuit in bi-directional power series resonance as claimed in claim 6, wherein the zener diode comprises:

1) the zener diode (ZD101) is parallel connected across the two ends of the first light emitting diode (LED101) of the bi-directional conducting light emitting diode set (L100), and a zener diode (ZD102) is parallel connected across the two ends of the second light emitting diode (LED102); or 2) the two zener diodes (ZD101) and (ZD102) are series connected in opposite directions and are further parallel connected across the two ends of the bi-directional conducting light emitting diode set (L100); or 3) or it can be replaced by parallel connecting a diode with bi-directional zener effect in the circuit of bi-directional conducting light emitting diode set (L100);

all the above said three circuits can avoid over high end voltage of the first light emitting diode (LED101) and the second light emitting diode (LED102); or if the bi-directional conducting light emitting diode set (L100) of the bi-directional light emitting diode drive circuit (U100) in the bi-directional light emitting diode drive circuit in bi-directional power series resonance of the present invention is selected to include the first light emitting diode (LED101) and the second light emitting diode (LED102) in parallel connection of opposite directions, the constitutions include the following:

said zener diodes (ZD101) and (ZD102) can be optionally constituted as needed by that a diode (CR201) and a zener diode (ZD101) are in series connection of forward polarities, and a diode (CR202) and a zener diode (ZD102) are in series connection of forward polarities, wherein their advantages are 1) the zener diode (ZD101) and (ZD102) can be protected from reverse current; 2) both the diode (CR201) and the zener diode (ZD101) as well as both the diode (CR202) and the zener diode (ZD102) have temperature compensation effect.

8. A bi-directional light emitting diode drive circuit in bi-directional power series resonance as claimed in claim 1, wherein the first light emitting diode (LED101) can be further installed with a charge/discharge device (ESD101), or the second light emitting diode (LED102) can be further installed with a charge/discharge device (ESD102), wherein the charge/discharge device (ESD101) and the charge/discharge device (ESD102) have the random charging or discharging characteristics which can stabilize the lighting stability of the first light emitting diode (LED101) and the second light emitting diode (LED102), whereby to reduce their lighting pulsations; the aforesaid charge/discharge devices (ESD101), (ESD102) can include various conventional charging and discharging batteries, or super-capacitors or capacitors.

9. A bi-directional light emitting diode drive circuit in bi-directional power series resonance as claimed in claim 1, wherein the application circuits with additionally installed charge/discharge device includes:

the bi-directional light emitting diode drive circuit in bi-directional power series resonance, wherein in its bi-directional light emitting diode drive circuit (U100), a charge/discharge device (ESD101) can be parallel connected across the two ends of the current limit resistor (R103) and the first light emitting diode (LED101) in series connection;

or a charge/discharge device (ESD102) can be further parallel connected across the two ends of the current limit resistor (R104) and the second light emitting diode (LED102) in series connection; wherein it is comprised of:

a charge/discharge device (ESD101) based on its polarity is parallel connected across the two ends of the first light emitting diode (LED101) and the current limit resistor (R103) in series connection, or is directly parallel connected across the two ends of the first light emitting diode (LED101), wherein the charge/discharge device (ESD101) has the random charge/discharge characteristics to stabilize the lighting operation and to reduce the lighting pulsation of the first light emitting diode (LED101);

if the second light emitting diode (LED102) is selected to use, a charge/discharge device (ESD102) based on its polarity is parallel connected across the two ends of the second light emitting diode (LED102) and the current limit resistor (R104) in series connection, wherein the charge/discharge device (ESD102) has the random charge/discharge characteristics to stabilize the lighting operation and to reduce the lighting pulsation of the second light emitting diode (LED102);

aforesaid charge/discharge devices (ESD101), (ESD102) can include various conventional charging and discharging batteries, or super-capacitors or capacitors.

10. A bi-directional light emitting diode drive circuit in bi-directional power series resonance as claimed in claim 1, wherein the application circuit with additional installed charge/discharge device includes: a first light emitting diode (LED101) is selected and is reversely parallel connected with a diode (CR100) in the bi-directional light emitting diode drive circuit (U100), then its main circuit structure is that a charge/discharge device (ESD101) based on its polarity is parallel connected across the two ends of the first light emitting diode (LED101) and the current limit resistor (R103) in series connection, wherein the charge/discharge device (ESD101) has the random charge/discharge characteristics to stabilize the lighting operation and to reduce the lighting pulsation of the first light emitting diode (LED101);

aforesaid charge/discharge devices (ESD101), (ESD102) can be include various conventional charging and discharging batteries, or super-capacitors or capacitors.

11. A bi-directional light emitting diode drive circuit in bi-directional power series resonance as claimed in claim 1, wherein the application circuit with additionally installed charge/discharge device includes:

in the bi-directional light emitting diode drive circuit (U100), when the current limit resistor (R100) is selected to replace the current limit resistors (R103), (R104) for the common current limit resistor of the bi-directional conducting light emitting diode set (L100), or the current limit resistors (R103), (R104) and (R100) are not installed, it is comprised of that:

a charge/discharge device (ESD101) is directly parallel connected across the two ends of the first light emitting diode (LED101) of the same polarity, and a charge/discharge device (ESD102) is directly parallel connected across the two ends of the second light emitting diode (LED102) of the same polarity, wherein the charge/discharge devices (ESD101) and (ESD102) has the random charge or discharge characteristics;

aforesaid charge/discharge devices (ESD101), (ESD102) can include various conventional charging and discharging batteries, or super-capacitors or capacitors.

12. A bi-directional light emitting diode drive circuit in bi-directional power series resonance as claimed in claim 1, wherein if the charge/discharge devices (ESD101) or (ESD102) used is uni-polar in its bi-directional light emitting diode drive circuit (U100), then after the first light emitting diode (LED101) is parallel connected with the uni-polar charge/discharge device (ESD101), a series connected diode (CR101) of forward polarity can be optionally installed as needed to prevent reverse voltage from damaging the uni-polar charge/discharge device; wherein after the second light emitting diode (LED102) is parallel connected with the unipolar charge/discharge device (ESD102), a series connected diode (CR102) of forward polarity can be optionally installed as needed to prevent reverse voltage from damaging the unipolar charge/discharge device; said charge/discharge devices (ESD101), (ESD102) can include various conventional charging and discharging batteries, or super-capacitors or capacitors.

13. A bi-directional light emitting diode drive circuit in bi-directional power series resonance as claimed in claim 1, wherein a diode (CR101) is parallel connected with at least one first light emitting diode (LED101) in opposite polarities, and a diode (CR102) is parallel connected with at least one second light emitting diode (LED102) in opposite polarities, wherein the two are further series connected in opposite directions to constitute a bi-directional conducting light emitting diode set (L100).

14. A bi-directional light emitting diode drive circuit in bi-directional power series resonance as claimed in claim 1, wherein in the bi-directional light emitting diode drive circuit (U100), it can be optionally installed with one bi-directional conducting light emitting diode set (L100) or with more than one bi-directional conducting light emitting diode sets (L100) in series connection, or in parallel connection, or in series and parallel connection, wherein if one set or more than one sets are selected to be installed, they can be driven together by the divided power at a common second impedance (Z102) or driven individually by the corresponding divided power at each of the multiple second impedances (Z102) which are in series connection or parallel connection.

15. A bi-directional light emitting diode drive circuit in bi-directional power series resonance as claimed in claim 1, wherein if the charge/discharge device is not installed, then current conduction to the light emitting diode is intermittent, whereby referring to the input voltage wave shape and duty cycle of current conduction, the light emitting forward current and the peak of light emitting forward voltage of each light emitting diode in the bi-directional conducting light emitting diode set (L100) can be correspondingly selected for the light emitting diode;

if current conduction to the light emitting diode is intermittent, the peak of light emitting forward voltage can be correspondingly selected based on the duty cycle of current conduction as long as the principle of that the peak of light emitting forward voltage does not damage the light emitting diode is followed.

16. A bi-directional light emitting diode drive circuit in bi-directional power series resonance as claimed in claim 1, wherein if the charge/discharge device is not installed, based on the value and wave shape of the aforesaid light emitting forward voltage, the corresponding current value and wave shape from the forward voltage vs. forward current ratio are produced; however the peak of light emitting forward current shall follow the principle not to damage the light emitting diode (LED101) or (LED102).

17. A bi-directional light emitting diode drive circuit in bi-directional power series resonance as claimed in claim 1, wherein it is series connected to the bi-directional power modulator of series connection type, wherein the bi-directional power modulator of series connection type includes the following:

a bi-directional power modulator of series connection type (300) including conventional electromechanical components or solid state power components and related electronic circuit components to modulate the bi-directional power output;

the circuit operating functions are the following:

1) the bi-directional power modulator of series connection type (300) is series connected with the bi-directional light emitting diode drive circuit (U100) to receive the bi-directional power from power source, whereby the bi-directional power is modulated by the bi-directional power modulator of series connection type (300) to execute power modulations such as pulse width modulation or current conduction phase angle control, or impedance modulation to drive the bi-directional light emitting diode drive circuit (U100); or 2) the bi-directional power modulator of series connection type (300) is series connected between the second impedance (Z102) and the bi-directional conducting light emitting diode set (L100) whereby the bi-directional divided power across the two ends of the second impedance (Z102) is modulated by the bi-directional power modulator of series connection type (300) to execute power modulations such as pulse width modulation or current conduction phase angle control, or impedance modulation to drive the bi-directional conducting light emitting diode set (L100).

18. A bi-directional light emitting diode drive circuit in bi-directional power series resonance as claimed in claim 1, wherein it is parallel connected to a bi-directional power modulator of parallel connection type, wherein the bi-directional power modulator of parallel connection type includes the following:

conventional electromechanical components or solid state power components and related electronic circuit components to modulate the bi-directional power output;

the circuit operating functions are the following:

1) the bi-directional power modulator of parallel connection type (400) is installed, wherein its output ends are for parallel connection with the bi-directional light emitting diode drive circuit (U100), while its input ends are provided for receiving the bi-directional power from the power source, whereby the bi-directional power is modulated by the bi-directional power modulator of parallel connection type (400) to execute power modulations such as pulse width modulation or current conduction phase angle control, or impedance modulation to drive the bi-directional light emitting diode drive circuit (U100); or 2) the bi-directional power modulator of parallel connection type (400) is installed, wherein its output ends are parallel connected with the input ends of the bi-directional conducting light emitting diode set (L100) while its input ends are parallel connected across the two ends of the second impedance (Z102), whereby the bi-directional divided power across the two ends of the second impedance (Z102) is modulated by the bi-directional power modulator of parallel connection type (400) to execute power modulations such as pulse width modulation or current conduction phase angle control, or impedance modulation to drive the bi-directional conducting light emitting diode set (L100).

19. A bi-directional light emitting diode drive circuit in bi-directional power series resonance as claimed in claim 1, wherein it is driven by the power outputted from a DC to AC inverter; comprising:

a DC to AC Inverter (4000) including conventional electromechanical components or solid state power components and related electronic circuit components, wherein its input ends are optionally provided as needed to receive input from a constant or variable voltage DC power, or a DC power rectified from an AC power, while its output ends are optionally selected as needed to supply a bi-directional AC power of bi-directional sinusoidal wave, or bi-directional square wave or bi-directional pulse wave with constant or variable voltage and constant or variable alternated polarity frequency or periods to be used as the power source to supply bi-directional power;

the circuit operating functions are the following:

the bi-directional light emitting diode drive circuit (U100) is parallel connected across the output ends of the conventional DC to AC inverter (4000); the input ends of the DC to AC inverter (4000) are optionally provided as needed to receive input from a constant or variable voltage DC power, or a DC power rectified from an AC power;

the output ends of the DC to AC inverter (4000) can be optionally selected as needed to provide the bi-directional sinusoidal wave, or bi-directional square wave, or bi-directional pulse wave power with constant or variable voltage and constant or variable alternated periods, wherein it can be further supplied to the two ends of the first impedance (Z101) and the second impedance (Z102) in series connection of the bi-directional light emitting diode drive circuit (U100), wherein the divided power across the two ends of the second impedance (Z102) is used to drive the bi-directional conducting light emitting diode set (L100);

in addition, the bi-directional light emitting diode drive circuit (U100) in series resonance can be controlled and driven by means of modulating the output power from the DC to AC inverter (4000), as well as by executing power modulations to the power outputted such as pulse width modulation, or current conduction phase angle control, or impedance modulation.

20. A bi-directional light emitting diode drive circuit in bi-directional power series resonance as claimed in claim 1, wherein the bi-directional light emitting diode drive circuit (U100) is arranged to be series connected with a least one conventional impedance component (500) and to be further parallel connected with the power source, wherein the impedance (500) includes:

1) a component with resistive impedance characteristics; or
2) a component with inductive impedance characteristics; or
3) a component with capacitive impedance characteristics; or
4) a single impedance component with the combined impedance characteristics of at least two of the resistive impedance, or inductive impedance, or capacitive impedance simultaneously, thereby to provide DC or AC impedances; or
5) a single impedance component with the combined impedance characteristics of inductive impedance and capacitive impedance, wherein its inherent parallel resonance frequency is the same as the frequency or period of bi-directional power from power source, thereby to produce a parallel resonance status; or
6) one kind or more than one kind of one or more than one capacitive impedance component, or inductive impedance component, or resistive impedance component, or by two kinds or more than two kinds of impedance components in series connection, or parallel connection, or series and parallel connection so as to provide DC or AC impedances; or
7) the mutual series connection of a capacitive impedance component and an inductive impedance component, wherein its inherent series resonance frequency is the same as the frequency or period of bi-directional power from power source, thereby to produce a series resonance status and the end voltage across two ends of the capacitive impedance component or the inductive impedance component appear in series resonance correspondingly;

or the capacitive impedance and the inductive impedance are in mutual parallel connection, whereby its inherent parallel resonance frequency is the same as the frequency or period of bi-directional power from power source, thereby to produce a parallel resonance status and appear the corresponding end voltage.

21. A bi-directional light emitting diode drive circuit in bi-directional power series resonance as claimed in claim 1, wherein the optionally installed inductive impedance component (I200) of the second impedance (Z102) can be further replaced by the power supply side winding of a transformer with inductive effect, wherein the self-coupled transformer (ST200) has a self-coupled voltage change winding (W0) with a voltage raising function, the b, c ends of the self-coupled voltage change winding (W0) of the self-coupled transformer (ST200) are the power supply side which replace the inductive impedance component (I200) of the second impedance (Z102) to constitute a second impedance (Z102), which is further series connected with the capacitor (C100) of the first impedance (Z101), wherein their inherent series resonance frequency is the same as the frequency of the AC power source, or the period of the constant or variable periodically alternated polarity power, thereby to produce a series resonance status; wherein the a, c output ends of the self-coupled voltage change winding (W0) of the self-coupled transformer (ST200) are arranged to provide AC power of voltage rise to drive the bi-directional conducting light emitting diode set (L100).

22. A bi-directional light emitting diode drive circuit in bi-directional power series resonance as claimed in claim 1, wherein the optionally installed inductive impedance component (I200) of the second impedance (Z102) can be further replaced by the power supply side winding of a transformer with inductive effect, wherein the self-coupled transformer (ST200) has a self-coupled voltage change winding (W0) with voltage drop function, in which the a, c ends of the self-coupled voltage change winding (W0) of the self-coupled transformer (ST200) are the power supply side which replace the inductive impedance component (I200) of the second impedance (Z102) to constitute a second impedance (Z102), which is series connected with the capacitor (C100) of the first impedance (Z101), wherein their inherent series resonance frequency is the same as the frequency of the AC power source, or the period of the constant or variable periodically alternated polarity power, thereby to produce a series resonance status; wherein the b, c output ends of the self-coupled voltage change winding (W0) of the self-coupled transformer (ST200) are arranged to provide AC power of voltage drop to drive the bi-directional conducting light emitting diode set (L100).

23. A bi-directional light emitting diode drive circuit in bi-directional power series resonance as claimed in claim 1, wherein the optionally installed inductive impedance component (I200) of the second impedance (Z102) can be further replaced by the power supply side winding of a transformer with inductive effect, wherein the separating type transformer (IT200) is comprised of a primary side winding (W1) and secondary side winding (W2), in which the primary side winding (W1) and secondary side winding (W2) are separated, wherein the primary side winding (W1) constitute a second impedance (Z102) which is series connected with the capacitor (C100) of the first impedance (Z101), wherein their inherent series resonance frequency produces a series resonance status with the frequency of the AC power source, or the period of the constant or variable periodically alternated polarity power, wherein the output voltage of the secondary side winding (W2) of the separating type transformer (IT200) can be optionally selected as needed to provide AC power of voltage rise or voltage drop to drive the bi-directional conducting light emitting diode set (L100);

the inductive impedance component (I200) of the second impedance (Z102) is replaced by the power supply side winding of the transformer while the secondary side of the separating type transformer (IT200) provides AC power of voltage rise or voltage drop to drive the bi-directional conducting light emitting diode set (L100).

* * * * *